US010757505B2

(12) United States Patent
Maeno et al.

(10) Patent No.: US 10,757,505 B2
(45) Date of Patent: Aug. 25, 2020

(54) SIGNAL PROCESSING DEVICE, METHOD, AND PROGRAM STORED ON A COMPUTER-READABLE MEDIUM, ENABLING A SOUND TO BE REPRODUCED AT A REMOTE LOCATION AND A DIFFERENT SOUND TO BE REPRODUCED AT A LOCATION NEIGHBORING THE REMOTE LOCATION

(71) Applicant: Sony Corporation, Tokyo (JP)

(72) Inventors: Yu Maeno, Tokyo (JP); Yuhki Mitsufuji, Tokyo (JP); Yoshiaki Oikawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/338,014

(22) PCT Filed: Sep. 22, 2017

(86) PCT No.: PCT/JP2017/034240
§ 371 (c)(1),
(2) Date: Mar. 29, 2019

(87) PCT Pub. No.: WO2018/066384
PCT Pub. Date: Apr. 12, 2018

(65) Prior Publication Data

US 2019/0238982 A1 Aug. 1, 2019

(30) Foreign Application Priority Data

Oct. 7, 2016 (JP) ..... 2016-198750

(51) Int. Cl.
*H04R 3/12* (2006.01)
*H04R 3/04* (2006.01)
(Continued)

(52) U.S. Cl.
CPC ..... *H04R 3/12* (2013.01); *G10K 11/34* (2013.01); *G10L 21/0202* (2013.01);
(Continued)

(58) Field of Classification Search
None
See application file for complete search history.

(56) References Cited

U.S. PATENT DOCUMENTS

2006/0215853 A1* 9/2006 Hiruma ..... H04S 7/30 381/97
2007/0098183 A1 5/2007 Enamito et al.
(Continued)

FOREIGN PATENT DOCUMENTS

JP 2006-270409 A 10/2006
JP 2007-121439 A 5/2007
(Continued)

OTHER PUBLICATIONS

International Search Report and English translation thereof dated Nov. 28, 2017 in connection with International Application No. PCT/JP2017/034240.
(Continued)

*Primary Examiner* — James K Mooney
(74) *Attorney, Agent, or Firm* — Wolf, Greenfield & Sacks, P.C.

(57) ABSTRACT

The present technology relates to a signal processing device, a signal processing method, and a program that enable different sounds to be reproduced in a remote location and a neighboring location.
A signal processing device includes: a remote filter unit configured to generate a remote sound reproduction signal for reproducing a sound in a remote audible region, by performing filter processing on a first sound source signal using a remote sound reproduction filter coefficient; and a
(Continued)

neighboring filter unit configured to generate a neighboring sound reproduction signal for reproducing a sound in a neighboring audible region that is different from the remote audible region, by performing filter processing on a second sound source signal using a neighboring sound reproduction filter coefficient. The present technology can be applied to a remote-neighborhood separate sound field formation device.

16 Claims, 11 Drawing Sheets

(51) Int. Cl.

| | |
|---|---|
| ***G10L 21/02*** | (2013.01) |
| ***H04R 5/02*** | (2006.01) |
| ***H04R 5/04*** | (2006.01) |
| ***H04R 1/40*** | (2006.01) |
| ***G10K 11/34*** | (2006.01) |
| *H04S 7/00* | (2006.01) |

(52) U.S. Cl.
CPC ..... *H04R 1/403* (2013.01); *H04R 3/04* (2013.01); *H04R 5/02* (2013.01); *H04R 5/04* (2013.01); *H04S 7/302* (2013.01)

(56) References Cited

U.S. PATENT DOCUMENTS

2012/0014525 A1* 1/2012 Ko ..... H04S 7/302 381/17
2013/0129103 A1* 5/2013 Donaldson ..... G10K 11/175 381/71.1
2013/0259254 A1* 10/2013 Xiang ..... G10K 11/175 381/73.1

FOREIGN PATENT DOCUMENTS

| | | | |
|---|---|---|---|
| JP | 2011-103543 | A | 5/2011 |
| JP | 2012-044572 | A | 3/2012 |
| JP | 2013-090038 | A | 5/2013 |
| WO | WO 2013/016735 | A2 | 1/2013 |

OTHER PUBLICATIONS

Kamakura et al., Practical development of a parametric loudspeaker, The Journal of the Acoustical Society of Japan, 2006, vol. 62, Issue 11, pp. 791-797 (translation 20 pages).
Written Opinion and English translation thereof dated Nov. 28, 2017 in connection with International Application No. PCT/JP2017/034240.
International Preliminary Report on Patentability and English translation thereof dated Apr. 18, 2019 in connection with International Application No. PCT/JP2017/034240.
Extended European Search Report dated Sep. 18, 2019, in connection with European Application No. 17858223.5.
Hiroaki et al., "Localized Sound Reproduction Using Circular Loudspeaker Array Based on Acoustic Evanescent Wave," 2012 IEEE International Conference on Acoustics, Speech, and Signal Processing (ICASSP 2012), Mar. 2012, pp. 221-224.

* cited by examiner

SIGNAL PROCESSING DEVICE, METHOD, AND PROGRAM STORED ON A COMPUTER-READABLE MEDIUM, ENABLING A SOUND TO BE REPRODUCED AT A REMOTE LOCATION AND A DIFFERENT SOUND TO BE REPRODUCED AT A LOCATION NEIGHBORING THE REMOTE LOCATION

CROSS-REFERENCE TO RELATED APPLICATIONS

This application is a U.S. National Stage entry under 35 U.S.C. § 371 of International Application No. PCT/JP2017/034240, filed in the Japan Patent Office on Sep. 22, 2017, which claims priority to Japanese Patent Application No. 2016-198750, filed in the Japan Patent Office on Oct. 7, 2016, each of which is incorporated by reference herein in its entirety.

TECHNICAL FIELD

The present technology relates to a signal processing device and a method, and a program, and relates particularly to a signal processing device and a method, and a program that are enabled to reproduce different sounds in a remote location and a neighboring location.

BACKGROUND ART

There has been conventionally known a technology of locally forming a sound field using a speaker.

As such a technology, for example, there is proposed a local sound field formation technology that is based on superdirective control using a parametric speaker (e.g. refer to Non-Patent Literature 1).

In addition, for example, there is also proposed a technology of forming a sound field in which a sound can be heard only in the neighborhood of a speaker array, by generating evanescent waves using the speaker array (e.g. refer to Patent Literature 1).

Meanwhile, in public places such as an airport and a station, operating information and a signage are presented using a video display. By using a voice in addition to a video, while it becomes possible to present content more effectively, the voice is delivered also to a large indefinite number of people not requiring the information.

In view of the foregoing, it becomes convenient to enable different sounds to be reproduced in a remote location and a neighboring location by presenting only the minimum guide to people in the remote location, and presenting detailed information to people in the neighboring location, for example. For example, at a cash dispenser in a bank, there is a voice intended to be heard only by a person performing a manipulation in the neighborhood of the cash dispenser, and a voice intended to be heard by people in a remote location, such as "you forgot something".

CITATION LIST

Non-Patent Literature

Non-Patent Literature 1: Kamakura et al., "Practical use of parametric speaker", Acoustical Society of Japan Journal, vol. 62, p. 791-797, 2006.

Patent Literature

Patent Literature 1: JP 2012-44572A

DISCLOSURE OF INVENTION

Technical Problem

Nevertheless, in the above-described technologies, it has been difficult to reproduce different sounds in a remote region and a neighboring region.

The present technology has been devised in view of such a situation, and enables different sounds to be reproduced in a remote location and a neighboring location.

Solution to Problem

A signal processing device according to an aspect of the present technology includes: a remote filter unit configured to generate a remote sound reproduction signal for reproducing a sound in a remote audible region, by performing filter processing on a first sound source signal using a remote sound reproduction filter coefficient; and a neighboring filter unit configured to generate a neighboring sound reproduction signal for reproducing a sound in a neighboring audible region that is different from the remote audible region, by performing filter processing on a second sound source signal using a neighboring sound reproduction filter coefficient.

The neighboring sound reproduction signal may be a signal for generating an evanescent wave.

The signal processing device may further include a neighboring sound field processing unit configured to decide a decay rate of the evanescent wave in accordance with a boundary position of the remote audible region and the neighboring audible region. The neighboring filter unit may perform filter processing using the neighboring sound reproduction filter coefficient corresponding to the decided decay rate among a plurality of the neighboring sound reproduction filter coefficients.

The signal processing device may further include a neighboring sound field processing unit configured to decide a position of a control point in accordance with a boundary position of the remote audible region and the neighboring audible region. The neighboring filter unit may perform filter processing using the neighboring sound reproduction filter coefficient corresponding to the decided position of the control point among a plurality of the neighboring sound reproduction filter coefficients.

The signal processing device may further include a remote sound field processing unit configured to decide a position of a control point in accordance with a boundary position of the remote audible region and the neighboring audible region. The remote filter unit may perform filter processing using the remote sound reproduction filter coefficient corresponding to the decided position of the control point among a plurality of the remote sound reproduction filter coefficients.

The remote sound reproduction signal may be a signal for generating a propagating wave.

The signal processing device may further include: a remote sound field processing unit configured to decide a gain in accordance with a boundary position of the remote audible region and the neighboring audible region; and a remote gain adjustment unit configured to perform gain adjustment of the first sound source signal or the remote sound reproduction signal on a basis of the decided gain.

The signal processing device may further include: a neighboring sound field processing unit configured to decide a gain in accordance with a boundary position of the remote audible region and the neighboring audible region; and a neighboring gain adjustment unit configured to perform gain adjustment of the second sound source signal or the neighboring sound reproduction signal on a basis of the decided gain.

The first sound source signal and the second sound source signal may be signals for reproducing sounds of mutually different pieces of content.

The signal processing device may further include: a speaker array configured to reproduce a sound on a basis of a signal obtained by synthesizing the remote sound reproduction signal and the neighboring sound reproduction signal.

The signal processing device may further include: a first speaker array configured to reproduce a sound on a basis of the remote sound reproduction signal; and a second speaker array configured to reproduce a sound on a basis of the neighboring sound reproduction signal.

A sound that is based on the remote sound reproduction signal may be reproduced at a timing different from a timing of a sound that is based on the neighboring sound reproduction signal.

A sound that is based on the remote sound reproduction signal may be a sound for masking of a sound that is based on the neighboring sound reproduction signal.

The signal processing device may further include: a sound field boundary control unit configured to decide a boundary position of the remote audible region and the neighboring audible region on a basis of a position of a listener in a space.

A signal processing method or a program according to an aspect of the present technology includes the steps of: generating a remote sound reproduction signal for reproducing a sound in a remote audible region, by performing filter processing on a first sound source signal using a remote sound reproduction filter coefficient; and generating a neighboring sound reproduction signal for reproducing a sound in a neighboring audible region that is different from the remote audible region, by performing filter processing on a second sound source signal using a neighboring sound reproduction filter coefficient.

According to an aspect of the present technology, a remote sound reproduction signal for reproducing a sound in a remote audible region is generated, by performing filter processing on a first sound source signal using a remote sound reproduction filter coefficient; and a neighboring sound reproduction signal for reproducing a sound in a neighboring audible region that is different from the remote audible region is generated, by performing filter processing on a second sound source signal using a neighboring sound reproduction filter coefficient.

Advantageous Effects of Invention

According to one aspect of the present technology, different sounds can be reproduced in a remote location and a neighboring location.

Note that the advantageous effects described here are not necessarily limitative, and any of the advantageous effects described in the present disclosure may be attained.

MODE(S) FOR CARRYING OUT THE INVENTION

Hereinafter, an embodiment to which the present technology is applied will be described with reference to the drawings.

First Embodiment

<Present Technology>

The present technology enables different sounds to be reproduced in a remote location and a neighboring location using a speaker array.

In the present technology, two sound fields are simultaneously formed by one speaker array obtained by linearly arranging a plurality of speakers, for example.

In this case, a sound field (hereinafter, will also be referred to as a neighboring sound reproduction sound field) in which a sound can be heard only in a speaker array neighboring region, and a sound field (hereinafter, will also be referred to as a remote sound reproduction sound field) in which a sound can be heard even in a remote location distant from the speaker array are simultaneously formed by the speaker array.

Here, the neighboring sound reproduction sound field is formed by reproducing a sound on the basis of a neighboring sound reproduction signal for generating an evanescent wave, for example. Note that the evanescent wave is a wave having such a property that a sound pressure exponentially decays by distance in a direction vertical to the speaker array.

The neighboring sound reproduction sound field that is based on such an evanescent wave is a sound field in which a sound pressure sufficient for hearing is maintained only in the neighborhood of the speaker array, and a sound pressure steeply decays in a remote location.

In contrast to this, the remote sound reproduction sound field is formed by reproducing a sound on the basis of a remote sound reproduction signal for generating a propagating wave propagating to a remote location, such as a planar wave and a spherical wave. Note that, hereinafter, the description will be continued assuming that the remote sound reproduction sound field is formed by a planar wave.

The remote sound reproduction sound field that is formed by such a propagating wave is a sound field in which a sound pressure sufficient for hearing is maintained even in a remote location distant from the speaker array.

Thus, it is possible to reproduce mutually different sounds in a speaker array neighborhood and a remote location by simultaneously forming such a neighboring sound reproduction sound field and a remote sound reproduction sound field, and reproducing sounds in such a manner that, in the speaker array neighborhood, a sound of the neighboring sound reproduction sound field is reproduced sufficiently larger than a sound of the remote sound reproduction sound field.

Figure 1:
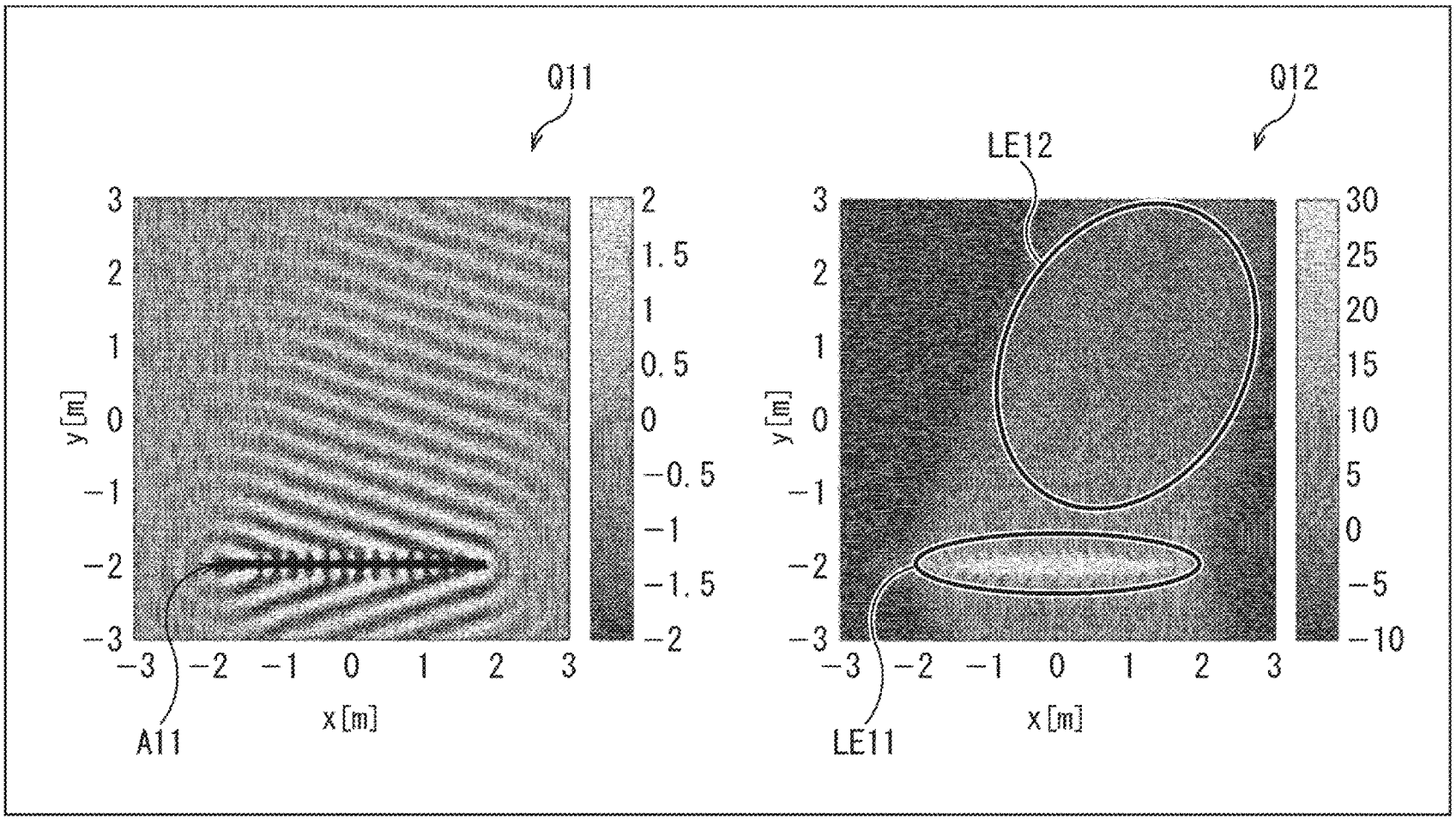
FIG. 1 is a diagram describing the present technology.

In such a case, a wave surface of a reproduced sound becomes as illustrated in FIG. 1, for example. Note that, in FIG. 1, a longitudinal direction and a traverse direction indicate directions in a space, and contrasting density in a portion indicated by an arrow Q11 indicates amplitude of the wave surface of the reproduced sound.

In this example, one linear speaker array is arranged at a position indicated by an arrow A11, and a sound (hereinafter, will also be referred to as a neighboring sound) that is based on a neighboring sound reproduction signal, and a sound (hereinafter, will also be referred to as a remote sound) that is based on a remote sound reproduction signal are simultaneously reproduced by the linear speaker array. In other words, the neighboring sound reproduction sound field and the remote sound reproduction sound field are simultaneously formed.

Here, because the neighboring sound is an evanescent wave and the remote sound is a planar wave, these waves become waves of different regions in a spatial spectrum, that is to say, a spatiotemporal spectrogram. Thus, these waves do not interfere with each other, and a listener can distinguish between the neighboring sound and the remote sound.

In addition, in this case, a sound pressure at each position in the space becomes as indicated by an arrow Q12, and a linear speaker array neighborhood becomes an audible region LE11 of the neighboring sound and a region existing at a position distant from the linear speaker array becomes an audible region LE12 of the remote sound. Note that contrasting densities at respective positions in a portion indicated by an arrow Q12 indicate sound pressures at these positions.

In this example, different sounds are respectively reproduced in mutually different regions called a neighboring audible region LE11 and a remote audible region LE12.

Figure 2:
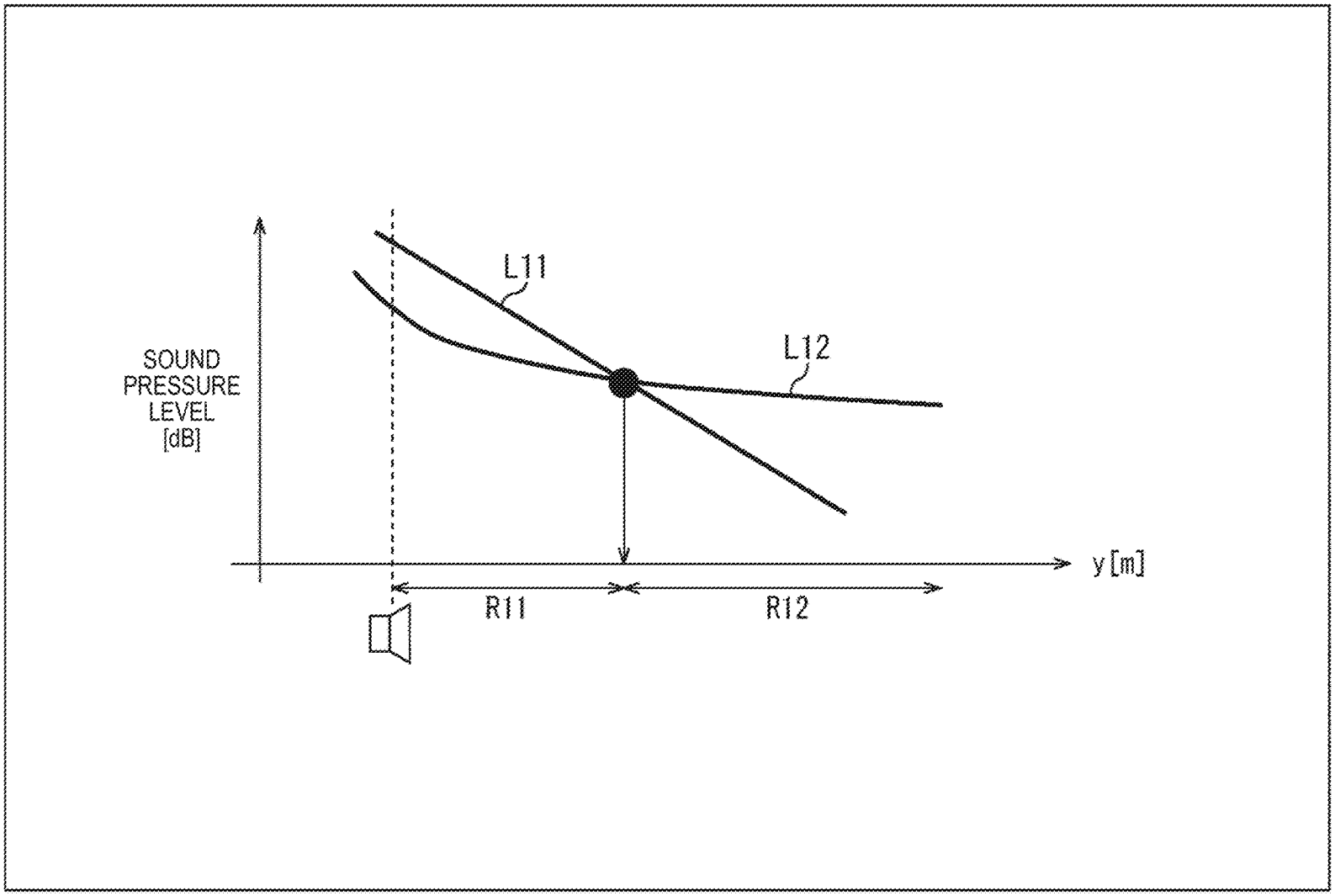
FIG. 2 is a diagram describing the present technology.

When a direction vertical to a direction in which a plurality of speakers constituting the linear speaker array is arranged is denoted as a y direction, a sound pressure of the neighboring sound and a sound pressure of the remote sound decay as illustrated in FIG. 2, for example, with respect to the y direction. Note that, in FIG. 2, a vertical axis indicates a sound pressure and a horizontal axis indicates a position in the y direction.

In FIG. 2, a straight line L11 indicates a sound pressure of the neighboring sound at each position in the y direction, and a sound pressure indicated by the straight line L11 becomes $1/e^y$ when a distance in the y direction from the linear speaker array is denoted by y. In contrast to this, a curved line L12 indicates a sound pressure of the remote sound at each position in the y direction, and a sound pressure indicated by the curved line L12 becomes 1/y when a distance in the y direction from the linear speaker array is denoted by y.

Accordingly, in the space, a region R11 in which the sound pressure of the neighboring sound is larger than that of the remote sound becomes the audible region LE11 illustrated in FIG. 1, and a region R12 in which the sound pressure of the remote sound is larger than that of the neighboring sound becomes the audible region LE12 illustrated in FIG. 1.

For example, in the region R11, a listener can hear not only the neighboring sound but also the remote sound, but a sound pressure difference between the neighboring sound and the remote sound can be made sufficiently large. It is therefore possible to cause the listener to hear the remote sound sufficiently small. In addition, in the region R12, a decay of the neighboring sound is large, and the listener can only hear the remote sound.

In this manner, by using the evanescent wave and the planar wave being mutually different in the way of decaying in the y direction, it becomes possible to form the region R11 in which a listener mainly hears the neighboring sound, and the region R12 in which the listener hears the remote sound.

Hereinafter, a boundary position of the region R11 and the region R12, that is to say, a position in the y direction at which the sound pressures of the neighboring sound and the remote sound become the same level (magnitude) will also be referred to as a sound field boundary position.

<Configuration Example of Remote-Neighborhood Separate Sound Field Formation Device>

Hereinafter, a more specific embodiment to which the present technology is applied will now be described.

Figure 3:
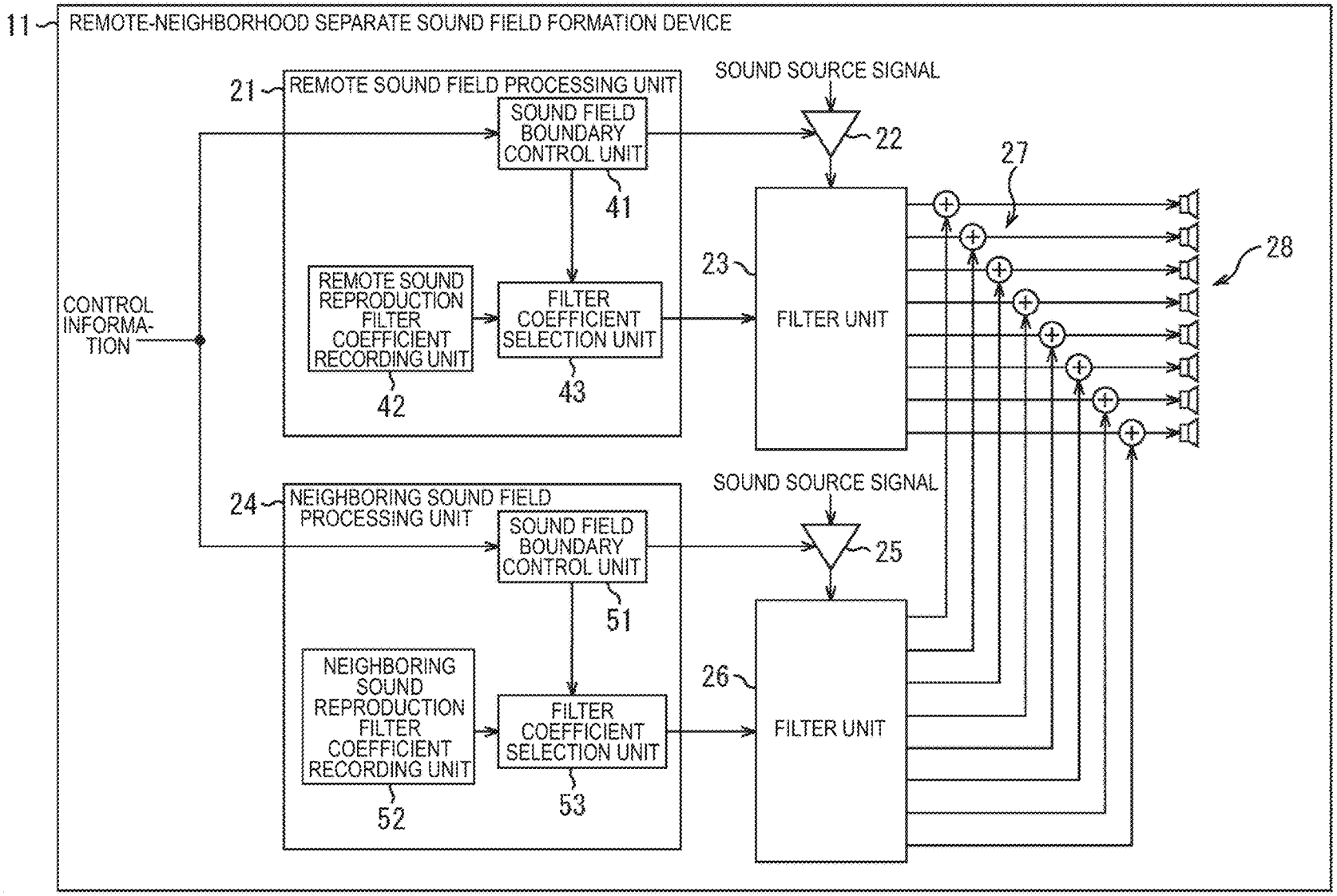
FIG. 3 is a diagram illustrating a configuration example of a remote-neighborhood separate sound field formation device.

FIG. 3 is a diagram illustrating a configuration example of an embodiment of a remote-neighborhood separate sound field formation device to which the present technology is applied.

A remote-neighborhood separate sound field formation device 11 illustrated in FIG. 3 is a signal processing device that reproduces different sounds in a remote location and a neighboring location. The remote-neighborhood separate sound field formation device 11 includes a remote sound field processing unit 21, a gain adjustment unit 22, a filter unit 23, a neighboring sound field processing unit 24, a gain adjustment unit 25, a filter unit 26, an addition unit 27, and a speaker array 28.

In the remote-neighborhood separate sound field formation device 11, control information for controlling a boundary position of a neighboring sound reproduction sound field and a remote sound reproduction sound field, that is to say, a sound field boundary position being a boundary position of an audible region of a neighboring sound and an audible region of a remote sound is supplied to the remote sound field processing unit 21 and the neighboring sound field processing unit 24.

For example, the control information is assumed to be listener position information indicating a position of a listener in a space, boundary position information indicating a position of a sound field boundary, or the like. Note that the boundary position information may be manually-input information or predefined information.

The remote sound field processing unit 21 decides a sound field boundary position on the basis of the supplied control information. The remote sound field processing unit 21 includes a sound field boundary control unit 41, a remote sound reproduction filter coefficient recording unit 42, and a filter coefficient selection unit 43.

The sound field boundary control unit 41 decides a sound field boundary position on the basis of the supplied control information, decides a gain value for gain adjustment of the remote sound on the basis of the decision result, and supplies the decided gain value to the gain adjustment unit 22. Hereinafter, a gain value for gain adjustment of the remote sound will also be specifically referred to as a remote sound gain value.

In addition, the sound field boundary control unit 41 generates remote sound reproduction filter coefficient selection information for selecting an appropriate remote sound reproduction filter coefficient from among a plurality of remote sound reproduction filter coefficients recorded in the remote sound reproduction filter coefficient recording unit 42, on the basis of the decision result of the sound field boundary position, and supplies the generated remote sound reproduction filter coefficient selection information to the filter coefficient selection unit 43.

The remote sound reproduction filter coefficient recording unit 42 prerecords a plurality of remote sound reproduction filter coefficients being acoustic filter coefficients for forming a remote sound reproduction sound field on a side more distant from the speaker array 28 than a predetermined sound field boundary position, and supplies the recorded remote sound reproduction filter coefficients to the filter coefficient selection unit 43.

On the basis of the remote sound reproduction filter coefficient selection information supplied from the sound field boundary control unit 41, the filter coefficient selection unit 43 selects one remote sound reproduction filter coefficient from among the plurality of remote sound reproduction filter coefficients recorded in the remote sound reproduction filter coefficient recording unit 42, and supplies the selected remote sound reproduction filter coefficient to the filter unit 23.

On the basis of the remote sound gain value supplied from the sound field boundary control unit 41, the gain adjustment unit 22 performs gain adjustment of a supplied sound source signal, and supplies the obtained sound source signal to the filter unit 23. The sound source signal supplied to the gain adjustment unit 22 is an acoustic signal of a time region for reproducing a remote sound.

By performing filter processing on the sound source signal supplied from the gain adjustment unit 22, using the remote sound reproduction filter coefficient supplied from the filter coefficient selection unit 43, the filter unit 23 generates a remote sound reproduction signal, and supplies the generated remote sound reproduction signal to the addition unit 27. In the filter unit 23, convolution processing of convoluting the sound source signal and the remote sound reproduction filter coefficient is performed as the filter processing.

The neighboring sound field processing unit 24 decides a sound field boundary position on the basis of the supplied control information. The neighboring sound field processing unit 24 includes a sound field boundary control unit 51, a neighboring sound reproduction filter coefficient recording unit 52, and a filter coefficient selection unit 53.

The sound field boundary control unit 51 decides a sound field boundary position on the basis of the supplied control information, decides a gain value for gain adjustment of the neighboring sound on the basis of the decision result, and supplies the decided gain value to the gain adjustment unit 25. Hereinafter, a gain value for gain adjustment of the neighboring sound will also be specifically referred to as a neighboring sound gain value.

In addition, the sound field boundary control unit 51 generates neighboring sound reproduction filter coefficient selection information for selecting an appropriate neighboring sound reproduction filter coefficient from among a plurality of neighboring sound reproduction filter coefficients recorded in the neighboring sound reproduction filter coefficient recording unit 52, on the basis of the decision result of the sound field boundary position, and supplies the generated neighboring sound reproduction filter coefficient selection information to the filter coefficient selection unit 53.

The neighboring sound reproduction filter coefficient recording unit 52 prerecords the plurality of neighboring sound reproduction filter coefficients being acoustic filter coefficients for forming a neighboring sound reproduction sound field on a side closer to the speaker array 28 than the predetermined sound field boundary position, and supplies the recorded neighboring sound reproduction filter coefficients to the filter coefficient selection unit 53.

On the basis of the neighboring sound reproduction filter coefficient selection information supplied from the sound field boundary control unit 51, the filter coefficient selection unit 53 selects one neighboring sound reproduction filter coefficient from among the plurality of neighboring sound reproduction filter coefficients recorded in the neighboring sound reproduction filter coefficient recording unit 52, and supplies the selected neighboring sound reproduction filter coefficient to the filter unit 26.

On the basis of the neighboring sound gain value supplied from the sound field boundary control unit 51, the gain adjustment unit 25 performs gain adjustment of a supplied sound source signal, and supplies the obtained sound source signal to the filter unit 26. The sound source signal supplied to the gain adjustment unit 25 is an acoustic signal of a time region for reproducing a neighboring sound.

Note that, here, the description will be given of an example in which the sound source signal supplied to the gain adjustment unit 22 and the sound source signal supplied to the gain adjustment unit 25 are signals for reproducing sounds of mutually different pieces of content, but these sound source signals may be the same signals.

By performing filter processing on the sound source signal supplied from the gain adjustment unit 25, using the neighboring sound reproduction filter coefficient supplied from the filter coefficient selection unit 53, the filter unit 26 generates a neighboring sound reproduction signal, and supplies the generated neighboring sound reproduction signal to the addition unit 27. In the filter unit 26, convolution processing of convoluting the sound source signal and the neighboring sound reproduction filter coefficient is performed as the filter processing.

The addition unit 27 generates a speaker drive signal for simultaneously reproducing a neighboring sound and a remote sound, by adding the remote sound reproduction signal supplied from the filter unit 23 and the neighboring sound reproduction signal supplied from the filter unit 26, and supplies the generated speaker drive signal to the speaker array 28. In other words, in the addition unit 27, the speaker drive signal is generated by synthesizing the remote sound reproduction signal and the neighboring sound reproduction signal.

The speaker array 28 is a speaker array obtained by arranging a plurality of speakers, such as a linear speaker array, a planar speaker array, an annular speaker array, or a spherical speaker array, for example, and reproduces a neighboring sound and a remote sound on the basis of the speaker drive signal supplied from the addition unit 27.

<Each Unit of Remote-Neighborhood Separate Sound Field Formation Device>

Figure 4:
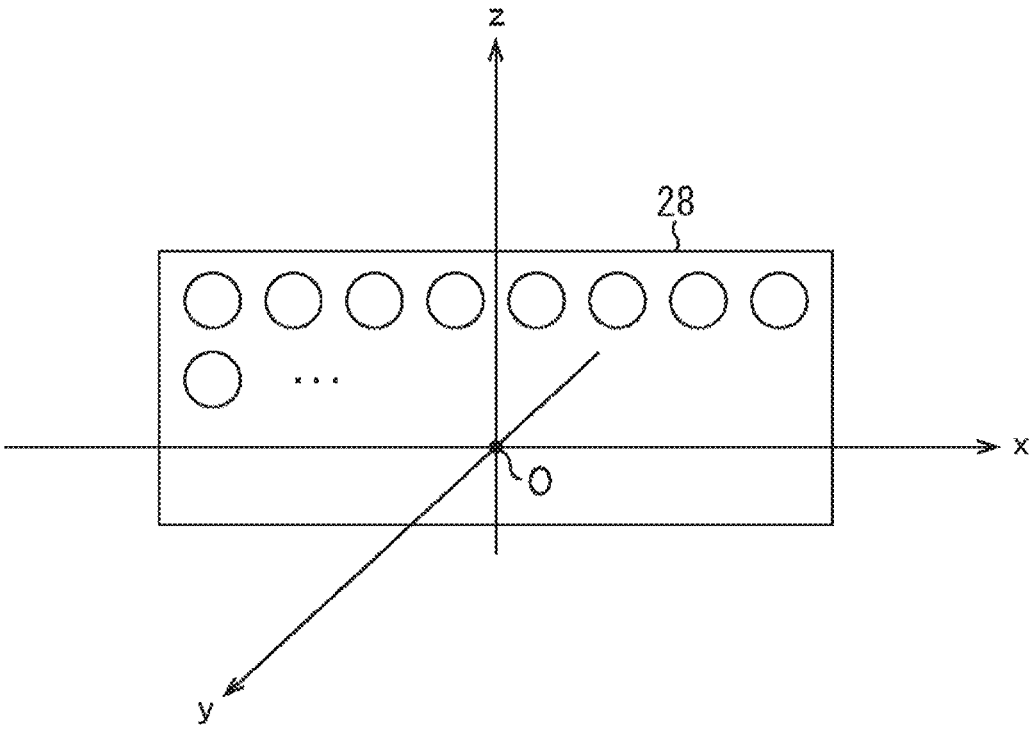
FIG. 4 is a diagram describing a coordinate system.

Here, a coordinate system used in the description given below will be described with reference to FIG. 4.

In other words, in the description given below, a center position of the speaker array 28 is regarded as an origin O of a three-dimensional orthogonal coordinate system.

In addition, three axes of the three-dimensional orthogonal coordinate system are regarded as an x-axis, a y-axis, and a z-axis that pass through the origin O, and are orthogonal to one another. Here, a direction of the x-axis, that is to say, an x direction is assumed to be direction in which the speakers constituting the speaker array 28 is arranged. In addition, a direction of the y-axis, that is to say, the y direction is assumed to be a direction vertical to the x direction, and a direction parallel to a direction in which sound waves are output from the speaker array 28, and a direction vertical to the x direction and the y direction is assumed to be a direction of the z-axis, that is to say, a z direction. In particular, the direction in which sound waves are output from the speaker array 28 is assumed to be a positive direction of the y direction.

Hereinafter, a position in a space, that is to say, a vector indicating a position in a space is assumed to be also described as (x, y, z) using an x-coordinate, a y-coordinate, and a z-coordinate. In addition, hereinafter, the description will be continued assuming that the speaker array 28 is a linear speaker array.

Next, each unit of the remote-neighborhood separate sound field formation device 11 illustrated in FIG. 3 will be described in more detail.

(Sound Field Boundary Control Unit)

First of all, the sound field boundary control unit 41 and the sound field boundary control unit 51 will be described.

In the sound field boundary control unit 41 and the sound field boundary control unit 51, the same processing is performed and a sound field boundary position is decided.

In other words, for example, listener position information is assumed to be supplied as control information. The listener position information indicating a position of a listener in a space can be obtained by image recognition performed on an image shot by a camera, detection of the listener that is performed using a sensor, an input of position information that is performed by a user or the like, or the like.

In such a case, for example, a sound field boundary position is decided in such a manner that the position of the listener that is indicated by the listener position information serving as control information is included in an audible region of a remote sound or a neighboring sound.

More specifically, for example, in a case where a plurality of listeners is present in a space, but a small number of listeners is present in the neighborhood of the speaker array 28, a sound field boundary position is decided in such a manner that a region including the listeners present in the neighborhood of the speaker array 28 becomes an audible region of a neighboring sound.

In contrast to this, for example, when the number of listeners present in the neighborhood of the speaker array 28 increases, and all the listeners no longer fall within the existing audible region of the neighboring sound, the audible region of the neighboring sound is made wider by moving the sound field boundary position to a position more distant in the y direction from the speaker array 28.

In this manner, a sound field boundary position may dynamically change during the reproduction of a neighboring sound or a remote sound, that is to say, during the reproduction of content.

In addition, for example, in a case where boundary position information is supplied as control information, a position indicated by the boundary position information is regarded as a sound field boundary position.

When a sound field boundary position is decided, a remote sound gain value, a neighboring sound gain value, remote sound reproduction filter coefficient selection information, and neighboring sound reproduction filter coefficient selection information are obtained in accordance with the decision result.

For example, a sound field boundary position to be set when sound fields are actually formed is defined by a remote sound gain value, a neighboring sound gain value, a position of a control point used when a remote sound reproduction sound field is formed, a decay rate of an evanescent wave that is obtainable when a neighboring sound reproduction sound field is formed, and the like.

Conversely speaking, by appropriately defining a remote sound gain value, a neighboring sound gain value, a position of a control point of a remote sound reproduction sound field, a decay rate of an evanescent wave, and the like, with respect to a decided arbitrary position, the remote sound reproduction sound field and the neighboring sound reproduction sound field can be formed in such a manner that the decided position becomes a sound field boundary position. In other words, by adjusting a remote sound gain value, a neighboring sound gain value, a position of a control point of a remote sound reproduction sound field, a decay rate of an evanescent wave, and the like, an arbitrary position can be set as a sound field boundary position.

Specifically, for example, in the case of reproducing a sound of content A and a sound of content B respectively as a remote sound and a neighboring sound, by adjusting gains of sound source signals of the sounds of these pieces of content, a sound field boundary position can be changed. In other words, control of a sound field boundary position can be performed.

Figure 5:
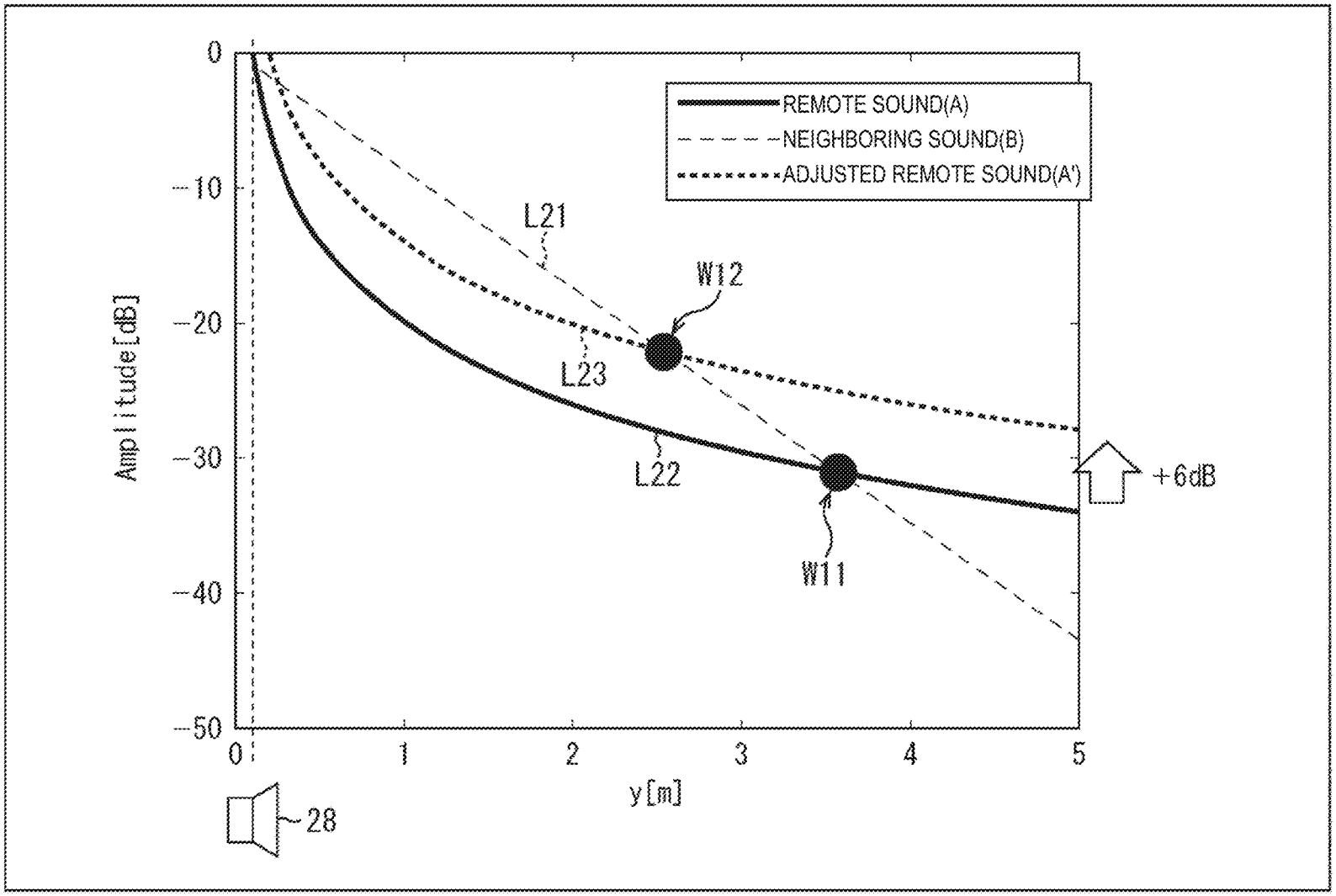
FIG. 5 is a diagram describing control of a sound field boundary position.

For example, it is assumed to be identified that, when a position of the speaker array 28 is set to a position with y=0 as illustrated in FIG. 5, a sound pressure of the content B, that is to say, a neighboring sound changes as indicated by a straight line L21, with respect to the y direction, and a sound pressure of the content A, that is to say, a remote sound changes as indicated by a curved line L22. Note that, in FIG. 5, a vertical axis indicates a sound pressure and a horizontal axis indicates a position in the y direction.

In this manner, when the sound pressure of the content A changes (decays) as indicated by the curved line L22, and the sound pressure of the content B changes (decays) as indicated by the straight line L21, an intersection position of the curved line L22 and the straight line L21, that is to say, a position indicated by an arrow W11 becomes a sound field boundary position.

When the gain of the content A is made larger, that is to say, a remote sound gain value is made larger, from such a state, for example, the sound pressure of the content A, that is to say, a remote sound changes as indicated by a curved line L23 with respect to the y direction.

In this example, the sound pressure of the content A at each position in the y direction becomes larger by gain adjustment of the content A, and accordingly, the sound field boundary position is moved to a position closer to the speaker array 28. In other words, a sound field boundary position gets close to the speaker array 28 in accordance with an increase in the sound pressure of the content A. In this case, an intersection position of the curved line L23 and the straight line L21, that is to say, a position indicated by an arrow W21 becomes a sound field boundary position.

In a similar manner, a sound field boundary position also changes by performing gain adjustment of the content B. In this case, when the gain of the content B is made larger, that is to say, when a neighboring sound gain value is made larger, a sound field boundary position gets away from the speaker array 28.

From such aspects, by appropriately defining a remote sound gain value or a neighboring sound gain value with respect to the decided sound field boundary position, a sound field boundary position to be set when a neighboring sound reproduction sound field and a remote sound reproduction sound field are simultaneously formed can be set to the decided sound field boundary position.

In the sound field boundary control unit 41 and the sound field boundary control unit 51, it is identified in advance that sound pressures of a remote sound and a neighboring sound become what level at each position in the y direction in a case where a remote sound reproduction filter coefficient and a neighboring sound reproduction filter coefficient that are prepared in advance are used. In other words, the straight line L21 and the curved line L22 are known.

Thus, the sound field boundary control unit 41 and the sound field boundary control unit 51 can obtain, for a decided sound field boundary position, such a remote sound gain value or a neighboring sound gain value that the decided sound field boundary position becomes a sound field boundary position when sound fields are actually formed.

Note that gain adjustment may be performed using only either one of a remote sound gain value and a neighboring sound gain value, or gain adjustment may be performed using both of these in combination. For example, when gain adjustment is substantially performed using only a remote sound gain value, a neighboring sound gain value is set to 1.

In a case where the control of a sound field boundary position is performed using only a remote sound gain value or a neighboring sound gain value, it is sufficient that only one (one type of) remote sound reproduction filter coefficient or only one (one type of) neighboring sound reproduction filter coefficient is prepared.

In addition, for example, a sound field boundary position also changes by changing a position of a control point of a remote sound reproduction filter coefficient for forming a remote sound reproduction sound field.

For example, in the sound field formation that uses a speaker array, there exists a control line including a control point group that is called a reference line and is parallel to a direction in which speakers constituting the speaker array are arranged, that is to say, the x direction here. In addition, a formed sound field can be matched an ideal sound field only on the control point.

In the remote sound reproduction filter coefficient recording unit 42, remote sound reproduction filter coefficients for a plurality of control points, that is to say, for positions in the y direction of the control points are prerecorded, and among these, a remote sound reproduction filter coefficient of one predetermined control point position is selected and supplied to the filter unit 23.

Figure 6:
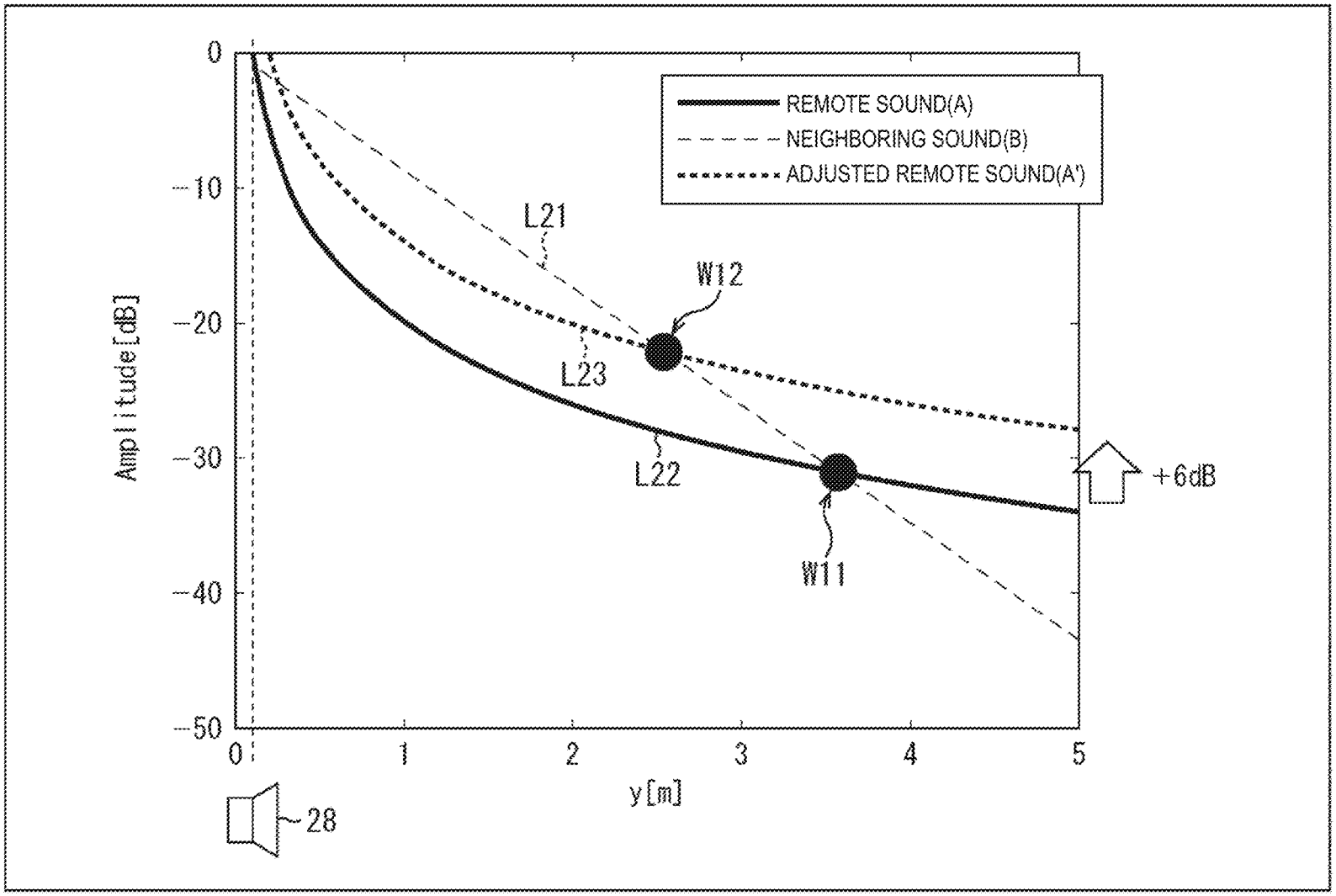
FIG. 6 is a diagram describing control of a sound field boundary position.

In the case of reproducing the sound of the content A and the sound of the content B respectively as a remote sound and a neighboring sound, when a position of a control point of a remote sound reproduction filter coefficient used for generation of a remote sound reproduction signal for reproducing the sound of the content A changes, a sound field boundary position changes as illustrated in FIG. 6, for example. Note that, in FIG. 6, a vertical axis indicates a sound pressure and a horizontal axis indicates a position in the y direction.

In the example in FIG. 6, a position of the speaker array 28 is set to a position with y=0, and a straight line L31 indicates a sound pressure of the content B, that is to say, a neighboring sound, at each position in the y direction. In addition, a curved line L32 indicates a sound pressure of the content A, that is to say, a remote sound, at each position in the y direction. In other words, the straight line L31 and the curved line L32 respectively indicate decay states of the sound pressures of the content B and the content A with respect to the y direction.

Note that, it is known that sound pressures of a remote sound and a neighboring sound become what level at each position in the y direction in a case where a remote sound reproduction filter coefficient and a neighboring sound reproduction filter coefficient are used as described above.

In this manner, when the sound pressure of the content A changes as indicated by the curved line L32, and the sound pressure of the content B changes as indicated by the straight line L31, an intersection position of the curved line L32 and the straight line L31, that is to say, a position indicated by an arrow W21 becomes a sound field boundary position.

For example, here, a position of a control point of a remote sound reproduction filter coefficient with which the sound pressure indicated by the curved line L32 is obtained is assumed to be y=y1.

In contrast to this, a remote sound reproduction signal for reproducing the sound of the content A is assumed to be generated using a remote sound reproduction filter coefficient with a position of a control point being y=y2 on a side more distant from the speaker array 28 than y1, in place of a remote sound reproduction filter coefficient with a position of a control point being y1.

In this case, the sound pressure of the content A changes as indicated by a curved line L33 with respect to the y direction, and a sound field boundary position becomes a position indicated by an arrow W22.

In this manner, it can be seen that, when a position of a control point is set to a position more distant from the speaker array 28 in the y direction, a sound field boundary position gets close to the speaker array 28. Conversely, when a position of a control point is brought closer to the speaker array 28 in the y direction, a sound field boundary position gets away from the speaker array 28.

From such aspects, by appropriately defining a control point of a remote sound reproduction sound field, that is to say, a control point of a remote sound reproduction filter coefficient with respect to a decided sound field boundary position, a sound field boundary position to be set when a neighboring sound reproduction sound field and a remote sound reproduction sound field are simultaneously formed can be set to the decided sound field boundary position.

In the sound field boundary control unit 41 and the sound field boundary control unit 51, it is identified in advance that sound pressures of a remote sound and a neighboring sound become what level at each position in the y direction in a case where a remote sound reproduction filter coefficient and a neighboring sound reproduction filter coefficient that are prepared in advance are used.

Thus, the sound field boundary control unit 41 and the sound field boundary control unit 51 can obtain, for a decided sound field boundary position, such a position of a control point of a remote sound reproduction filter coefficient that the decided sound field boundary position becomes a sound field boundary position when sound fields are actually formed.

Furthermore, for example, a sound field boundary position also changes by changing a sound pressure decay rate of a neighboring sound reproduction filter coefficient for forming a neighboring sound reproduction sound field, that is to say, a decay rate of an evanescent wave.

In the neighboring sound reproduction filter coefficient recording unit 52, neighboring sound reproduction filter coefficients for respective combinations of control points and constants α indicating sound pressure decay rates in the y direction are prerecorded, and among these, one neighboring sound reproduction filter coefficient is selected and supplied to the filter unit 26.

Figure 7:
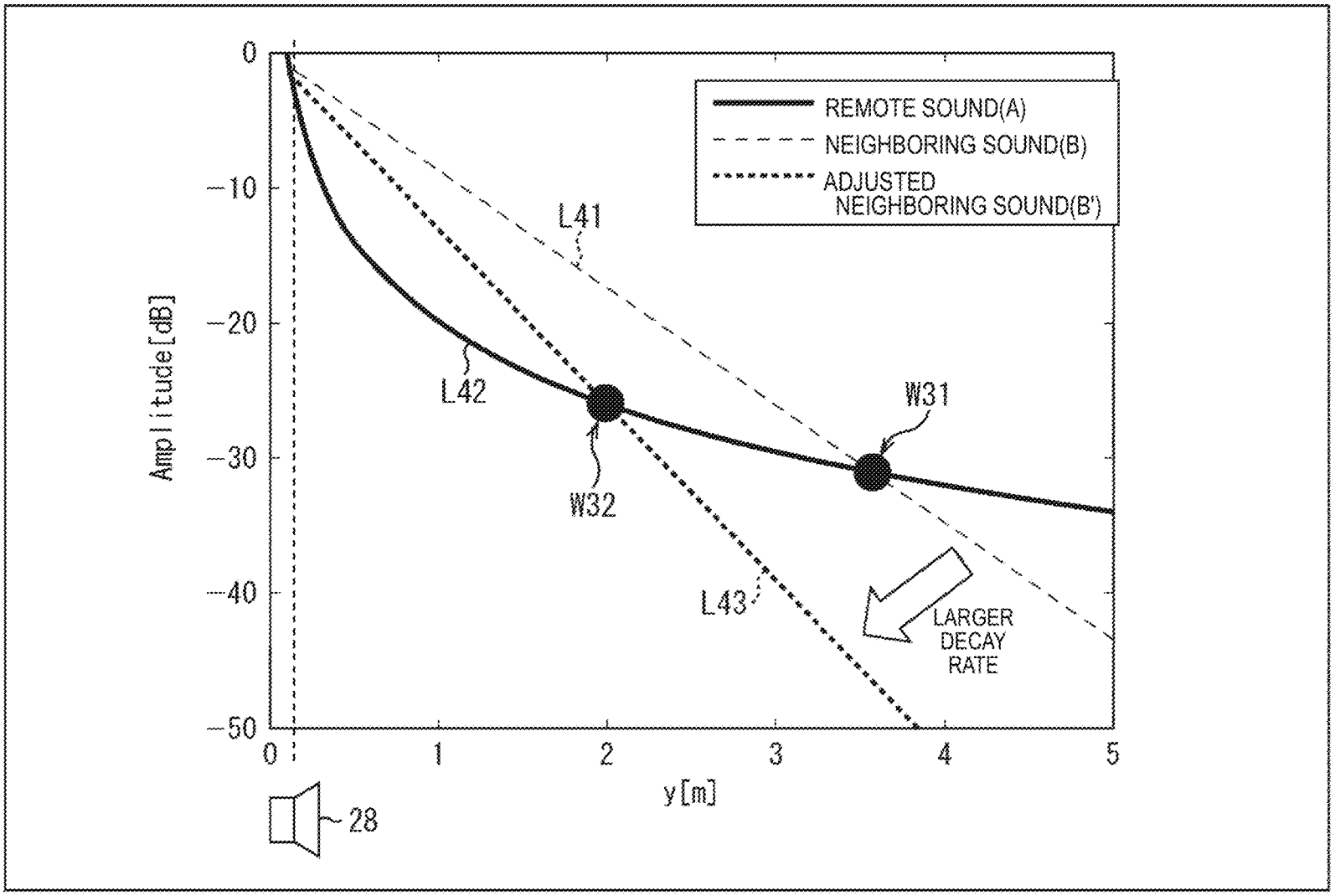
FIG. 7 is a diagram describing control of a sound field boundary position.

For example, in the case of reproducing the sound of the content A and the sound of the content B respectively as a remote sound and a neighboring sound, when a constant α of a neighboring sound reproduction filter coefficient used for generation of a neighboring sound reproduction signal for reproducing the sound of the content B, that is to say, a sound pressure decay rate changes, a sound field boundary position changes as illustrated in FIG. 7, for example. Note that, in FIG. 7, a vertical axis indicates a sound pressure and a horizontal axis indicates a position in the y direction.

In the example in FIG. 7, a position of the speaker array 28 is set to a position with y=0, and a straight line L41 indicates a sound pressure of the content B, that is to say, a neighboring sound, at each position in the y direction. In addition, a curved line L42 indicates a sound pressure of the content A, that is to say, a remote sound, at each position in the y direction. In other words, the straight line L41 and the curved line L42 respectively indicate decay states of the sound pressures of the content B and the content A with respect to the y direction.

In this manner, when the sound pressure of the content A changes as indicated by the curved line L42, and the sound pressure of the content B changes as indicated by the straight line L41, an intersection position of the curved line L42 and the straight line L41, that is to say, a position indicated by an arrow W31 becomes a sound field boundary position.

For example, here, a value of a constant α of a neighboring sound reproduction filter coefficient with which the sound pressure indicated by the straight line L41 is obtained is assumed to be al.

In contrast to this, a neighboring sound reproduction signal for reproducing the sound of the content B is assumed to be generated using a neighboring sound reproduction filter coefficient with a constant α=α2 at which a sound pressure decay rate is larger than that of when a constant α=α1 is set, in place of a neighboring sound reproduction filter coefficient with a constant α=α1.

In this case, the sound pressure of the content B changes as indicated by a straight line L43 with respect to the y direction, and a sound field boundary position becomes a position indicated by an arrow W32.

In this manner, it can be seen that, when a neighboring sound reproduction filter coefficient with a larger sound pressure decay rate is used, a sound field boundary position gets close to the speaker array 28. Conversely, when a neighboring sound reproduction filter coefficient with a smaller sound pressure decay rate is used, a sound field boundary position gets away from the speaker array 28.

From such aspects, by appropriately defining a sound pressure decay rate of a neighboring sound reproduction filter coefficient, that is to say, a constant α with respect to a decided sound field boundary position, a sound field boundary position to be set when a neighboring sound reproduction sound field and a remote sound reproduction sound field are simultaneously formed can be set to the decided sound field boundary position.

In the sound field boundary control unit 51 and the sound field boundary control unit 41, it is identified in advance that sound pressures of a remote sound and a neighboring sound become what level at each position in the y direction in a case where a remote sound reproduction filter coefficient and a neighboring sound reproduction filter coefficient that are prepared in advance are used.

Thus, the sound field boundary control unit 51 and the sound field boundary control unit 41 can obtain, for a decided sound field boundary position, such a constant α of a neighboring sound reproduction filter coefficient that the decided sound field boundary position becomes a sound field boundary position when sound fields are actually formed.

Note that a neighboring sound reproduction filter coefficient is prepared for each combination of a control point and a constant α indicating a sound pressure decay rate, but a sound field boundary position also changes by changing the control point of the neighboring sound reproduction filter coefficient. Accordingly, an appropriate control point may be decided in accordance with a sound field boundary position also for the neighboring sound reproduction filter coefficient.

As described above, a sound field boundary position changes depending on a remote sound gain value, a neighboring sound gain value, a control point of a remote sound reproduction filter coefficient, and a control point and a constant α of a neighboring sound reproduction filter coefficient.

Thus, the sound field boundary control unit 41 and the sound field boundary control unit 51 decide, for a decided sound field boundary position, an appropriate combination of a remote sound gain value, a neighboring sound gain value, a control point of a remote sound reproduction filter coefficient, and a control point and a constant α of a neighboring sound reproduction filter coefficient.

In this case, some of a remote sound gain value, a neighboring sound gain value, a control point of a remote sound reproduction filter coefficient, a control point of a neighboring sound reproduction filter coefficient, and a constant α of a neighboring sound reproduction filter coefficient may be dynamically decided, and the remaining values may be predefined.

In particular, in deciding each parameter such as a remote sound gain value, in some cases, there are some points to be considered. For example, a desired sound pressure is desired to be ensured at a predetermined position in the y direction. In addition, in sound field formation, an audible region of a remote sound or a neighboring sound needs to be provided on a side more distant from the speaker array 28 than a control point.

Thus, for example, even if only a control point of a remote sound reproduction filter coefficient is changed in accordance with a sound field boundary position, there is a possibility that a desired sound pressure fails to be ensured, or an audible region fails to be formed at an appropriate position. Nevertheless, if a plurality of parameters is dynamically decided by changing not only a control point of a remote sound reproduction filter coefficient but also a remote sound gain value and a neighboring sound gain value in combination, for example, it becomes possible to ensure a desired sound pressure, and to form an audible region at an appropriate position.

When a value of each parameter is decided with respect to a sound field boundary position in this manner, for example, the sound field boundary control unit 41 supplies, to the filter coefficient selection unit 43, information indicating a position of the decided control point of the remote sound reproduction filter coefficient, as remote sound reproduction filter coefficient selection information. In addition, for example, the sound field boundary control unit 51 supplies, to the filter coefficient selection unit 53, information indicating a position of the decided control point and the decided constant $\alpha$ of the neighboring sound reproduction filter coefficient, as neighboring sound reproduction filter coefficient selection information.

(Remote Sound Reproduction Filter Coefficient Recording Unit)

The remote sound reproduction filter coefficient recording unit 42 records remote sound reproduction filter coefficients for respective positions of a plurality of control points.

For example, the remote sound reproduction filter coefficient is assumed to be obtained in advance by a spectral division method (SDM).

Note that the SDM is described in detail in "Jens Ahrens and Sascha Spors, "Sound Field Reproduction Using Planar and Linear Arrays of Loudspeakers", in IEEE TRANSACTIONS ON AUDIO, SPEECH, AND LANGUAGE PROCESSING, VOL. 18, NO. 8, NOVEMBER 2010.", and the like, for example.

For example, a sound field P (v, $n_{tf}$) in a three-dimensional free space is represented as indicated in the following formula (1).

[Math. 1]

$$P(v,n_{tf})=\int_{\infty}^{-\infty}(v_0,n_{tf})(v,v_0,n_{tf})dx_0 \tag{1}$$

Note that, in Formula (1), $n_{tf}$ denotes a time frequency index, and v denotes a vector indicating a position in a space and v=(x, y, z) is set. In addition, in Formula (1), $v_0$ denotes a vector indicating a predetermined position on the x-axis, and $v_0=(x_0, 0, 0)$ is set. Note that, hereinafter, a position indicated by the vector v will also be referred to as a position v, and a position indicated by the vector $v_0$ will also be referred to as a position $v_0$.

Furthermore, in Formula (1), D ($v_0$, $n_{tf}$) denotes a drive signal of a secondary sound source, and G (v, $v_0$, $n_{tf}$) denotes a transfer function between the position v and the position $v_0$. The drive signal D ($v_0$, $n_{tf}$) of the secondary sound source corresponds to a remote sound reproduction signal.

In such calculation of Formula (1), in a space region, a form of convolution of the drive signal D ($v_0$, $n_{tf}$) and the transfer function G (v, $v_0$, $n_{tf}$) is employed, and when spatial Fourier transform of the sound field P (v, $n_{tf}$) indicated in Formula (1) is performed in the x-axis direction, a resultant value becomes as indicated in the following formula (2).

[Math. 2]

$$P_F(n_{sf},y,z,n_{tf})=D_F(n_{sf},n_{tf})G_F(n_{sf},y,z,n_{tf}) \tag{2}$$

Note that, in Formula (2), $n_{sf}$ denotes a spatial frequency index.

In this manner, when spatial Fourier transform of the sound field P (v, $n_{tf}$) is performed, as indicated in Formula (2), a sound field $P_F$ ($n_{sf}$, y, z, $n_{tf}$) of a spatial frequency domain is represented by a product of a drive signal $D_F$ ($n_{st}$, $n_{tf}$) and a transfer function $G_F$ ($n_{sf}$, y, z, $n_{tf}$) of the spatial frequency domain. Accordingly, spatial frequency representation of a drive signal of a secondary sound source becomes as indicated in the following formula (3).

[Math. 3]

$$D_F(n_{sf}, n_{tf}) = \frac{P_F(n_{sf}, y, Z, n_{tf})}{G_F(n_{sf}, y, Z, n_{tf})} \tag{3}$$

In addition, in the case of using a secondary sound source on a straight line, an actually-formed sound field can be matched an ideal sound field only on a control point parallel to the straight line, that is to say, only on a reference line. Thus, when a position in the y direction of the control point is assumed to be $y=y_{ref}$, and in addition, z=0 is assumed to be set for considering sound field formation on a horizontal surface, Formula (3) becomes as indicated in the following formula (4).

[Math. 4]

$$D_F(n_{sf}, n_{tf}) = \frac{P_F(n_{sf}, y_{ref}, 0, n_{tf})}{G_F(n_{sf}, y_{ref}, 0, n_{tf})} \tag{4}$$

The drive signal $D_F$ ($n_{sf}$, $n_{tf}$) of the secondary sound source that is indicated by this formula (4) is a drive signal for forming, assuming that a position with $y=y_{ref}$ is a control point, an ideal sound field on the control point.

In addition, for example, as a desired sound field $P_F$ ($n_{sf}$, $y_{ref}$, 0, $n_{tf}$), a point sound source model $P_{ps}$ ($n_{sf}$, $y_{ref}$, 0, $n_{tf}$) can be used as indicated in the following formula (5).

[Math. 5]

$$P_{ps}(n_{sf}, y_{ref}, 0, n_{tf}) = S(n_{tf}) \times e^{jk_x x_{ps}} \times \begin{cases} -\frac{j}{4}H_0^{(2)}\left(\sqrt{\left(\frac{\omega}{c}\right)^2 - k_x^2}\,(y_{ref} - y_{ps})\right), & |k_x| < \left|\frac{\omega}{c}\right| \\ \frac{1}{2\pi}K_0\left(\sqrt{k_x^2 - \left(\frac{\omega}{c}\right)^2}\,(y_{ref} - y_{ps})\right), & \left|\frac{\omega}{c}\right| < |k_x| \end{cases} \tag{5}$$

Note that, in Formula (5), S ($n_{tf}$) denotes a sound source signal of a sound to be reproduced, j denotes an imaginary unit, and $k_x$ denotes a wave number in the x-axis direction. In addition, $x_{ps}$ and $y_{ps}$ respectively denote an x-coordinate and a y-coordinate indicating a position of the point sound source, w denotes an angular frequency, and c denotes a sound speed. Furthermore, $H_0^{(2)}$ denotes a Hankel function of the second kind and $K_0$ denotes a Bessel function. Note that, because a remote sound reproduction filter coefficient is independent of a sound source, here, S ($n_{tf}$)=1 is set.

In addition, the transfer function $G_F$ ($n_{sf}$, $y_{ref}$, 0, $n_{tf}$) can be represented as indicated in the following formula (6).

[Math. 6]

$$G_F(n_{sf}, y_{ref}, 0, n_{tf}) = \begin{cases} -\frac{j}{4}H_0^{(2)}\left(\sqrt{\left(\frac{\omega}{c}\right)^2 - k_x^2}\,y_{ref}\right), & |k_x| < \left|\frac{\omega}{c}\right| \\ \frac{1}{2\pi}K_0\left(\sqrt{k_x^2 - \left(\frac{\omega}{c}\right)^2}\,y_{ref}\right), & \left|\frac{\omega}{c}\right| < |k_x| \end{cases} \tag{6}$$

Using Formulae (4), (5), and (6) described above, the drive signal $D_F$ ($n_{sf}$, $n_{tf}$), that is to say, a spatial frequency spectrum $D_F$ ($n_{sf}$, $n_{tf}$) of a remote sound reproduction signal is obtained.

Next, by performing spatial frequency synthesis of the spatial frequency spectrum $D_F$ ($n_{sf}$, $n_{tf}$) using discrete Fourier transform (DFT), a time frequency spectrum D (l, $n_{tf}$) is obtained. In other words, by calculating the following formula (7), the time frequency spectrum D (l, $n_{tf}$) is calculated.

[Math. 7]

$$D(1, n_{tf}) = \sum_{n_{sf}=0}^{M_{ds}-1} D_F(n_{sf}, n_{tf}) e^{-j\frac{2\pi l n_{sf}}{M_{ds}}} \tag{7}$$

Note that, in Formula (7), 1 denotes a speaker index for identifying a speaker constituting the speaker array 28, and indicating a position in the x direction of the speaker, and $M_{ds}$ denotes the number of samples of DFT.

Furthermore, time frequency synthesis of the time frequency spectrum D (l, $n_{t\ f}$) is performed using inverse discrete Fourier transform (IDFT), and a speaker drive signal d (l, $n_d$) of each speaker of the speaker array 28 being a temporal signal is obtained. Specifically, by performing calculation of the following formula (8), the speaker drive signal d (l, $n_d$) is calculated. The speaker drive signals d (l, $n_d$) of the respective speakers are remote sound reproduction signals.

[Math. 8]

$$d(l, n_d) = \frac{1}{M_{dt}} \sum_{n_{tf}=0}^{M_{dt}-1} D(l, n_{tf}) e^{j\frac{2\pi n_d n_{tf}}{M_{dt}}}. \tag{8}$$

Note that, in Formula (8), $n_d$ denotes a time index and Mat denotes the number of samples of IDFT.

The speaker drive signal d (l, $n_d$) obtained in this manner represents a filter coefficient itself that is independent of a sound source. Thus, a value obtained by replacing the time index $n_d$ of the speaker drive signal d (l, $n_d$) with a time index m is assumed to be a remote sound reproduction filter coefficient $h_f$ (l, m) obtained for a position ($x_{p\ s}$, $y_{p\ s}$) of a point sound source and a position $y=y_{r\ e\ f}$ of a control point.

Here, for one control point, the remote sound reproduction filter coefficient $h_f$ (l, m) is obtained for each speaker identified by the speaker index l of the speaker array 28.

In the remote sound reproduction filter coefficient recording unit 42, remote sound reproduction filter coefficients $h_f$ (l, m) of the plurality of respective control points are prerecorded.

Accordingly, among the remote sound reproduction filter coefficients $h_f$ (l, m) of the plurality of respective control points, the filter coefficient selection unit 43 reads out, from the remote sound reproduction filter coefficient recording unit 42, a remote sound reproduction filter coefficient $h_f$ (l, m) of the same control point as a control point indicated by the remote sound reproduction filter coefficient selection information supplied from the sound field boundary control unit 41, and supplies the read remote sound reproduction filter coefficient $h_f$ (l, m) to the filter unit 23.

Note that, in the case of using a planar secondary sound source when a remote sound reproduction filter coefficient is obtained, a control point group becomes planar, but also in such a case, a remote sound reproduction filter coefficient can be obtained similarly to the case of using a secondary sound source on a straight line.

(Neighboring Sound Reproduction Filter Coefficient Recording Unit)

The neighboring sound reproduction filter coefficient recording unit 52 records neighboring sound reproduction filter coefficients for respective combinations of positions of a plurality of control points and a plurality of constants α. These neighboring sound reproduction filter coefficients are filter coefficients of acoustic filters for generating evanescent waves decaying in the y direction, by the speaker array 28.

Such neighboring sound reproduction filter coefficients are obtained in the following manner, for example.

For example, in a three-dimensional free space, a sound field p (v, t) at a time t at an arbitrary position v satisfies a wave motion equation indicated in the following formula (9).

[Math. 9]

$$\nabla^2 p(v, t) - \frac{1}{c^2} \frac{\partial^2 p(v, t)}{\partial t^2} = 0. \tag{9}$$

Note that, in Formula (9), c denotes a sound speed and $\nabla^2$ is as indicated in the following formula (10).

[Math. 10]

$$\nabla^2 = \frac{\partial^2}{\partial x^2} + \frac{\partial^2}{\partial y^2} + \frac{\partial^2}{\partial z^2}. \tag{10}$$

In addition, when inverse time Fourier transform T(t) is assumed to be as indicated in the following formula (11), time Fourier transform F (•) becomes as indicated in the following formula (12).

[Math. 11]

$$T(t) = \frac{1}{2\pi} \int_{-\infty}^{\infty} \overline{T}(\omega) e^{j\omega t} d\omega. \tag{11}$$

[Math. 12]

$$F\left(\frac{\partial^2 T(t)}{\partial t^2}\right) = (j\omega)^2 \overline{T}(\omega). \tag{12}$$

Note that, in Formulae (11) and (12), j denotes an imaginary unit and w denotes an angular frequency.

Here, when variable separation of Formula (9) described above is performed as indicated in the following formula (13), a spatial differential and a time differential are separated, and furthermore, Formula (12) is used, a Helmholtz equation indicated in the following formula (14) is obtained.

[Math. 13]

$$p(v, t) = X(v)T(t). \tag{13}$$

[Math. 14]

$$\nabla^2 P(v, \omega) + \left(\frac{\omega}{c}\right)^2 P(v, \omega) = 0. \tag{14}$$

Note that, in Formula (14), P (v, w) denotes a sound field of the angular frequency ω at the position v. In addition, general solution of the Helmholtz equation indicated in Formula (14) that represents a planar wave propagating in a direction represented by an angular frequency $\omega_{p\ w}$, a wave number $k_{p\ w,\ x}$, a wave number $k_{p\ w,\ y}$, and a wave number $k_{p\ w,\ z}$ that are obtainable when an angular frequency is denoted by $\omega_{p\ w}$, and respective wave numbers in the x direction, the y direction, and the z direction are denoted by $k_{p\ w,\ x}$, $k_{p\ w,\ y}$, and $k_{p\ w,\ z}$ becomes as indicated in the following formula (15).

[Math. 15]

$$P(v,w)=2\pi\delta(\omega-\omega_{pw})e^{-j(k_{pw,x}x+k_{pw,y}y+k_{p,z}z)} \tag{15}$$

Note that, in Formula (15), $\delta(\omega-\omega_{p\ w})$ denotes a delta function.

Here, in a wavenumber domain, a relationship indicated in the following formula (16) is satisfied.

[Math. 16]

$$\left(\frac{\omega}{c}\right)^2 = k_{pw,x}^2 + k_{pw,y}^2 + k_{pw,z}^2. \tag{16}$$

When Formula (16) is solved for the wave number $k_{p\ w,\ y}$ in the y direction, solution becomes as indicated in the following formula (17).

[Math. 17]

$$k_{pw,y} = \begin{cases} \pm\sqrt{\left(\frac{\omega}{c}\right)^2 - k_{pw,x}^2 - k_{pw,z}^2} & \text{for } \sqrt{k_{pw,x}^2 + k_{pw,z}^2} < \left|\frac{\omega}{c}\right| \\ \pm j\sqrt{k_{pw,x}^2 + k_{pw,z}^2 - \left(\frac{\omega}{c}\right)^2} & \text{for } \left|\frac{\omega}{c}\right| < \sqrt{k_{pw,x}^2 + k_{pw,z}^2} \end{cases}. \tag{17}$$

A wave of the wave number $k_{p\ w,\ y}$ indicated on the upper row, that is to say, the upper side of this formula (17) represents a normal propagating wave, and a wave of the wave number $k_{p\ w,\ y}$ indicated on the lower row, that is to say, the lower side of Formula (17) represents an evanescent wave.

Thus, when the wave number $k_{p\ w,\ y}$ of the evanescent wave indicated on the lower row of Formula (17) is substituted into the sound field P (v, ω) indicated in Formula (15), the resultant value becomes as indicated in the following formula (18).

[Math. 18]

$$P(v,\omega) = 2\pi\delta(\omega-\omega_{pw})e^{-\sqrt{k_{pw,x}^2+k_{pw,z}^2-\left(\frac{\omega}{c}\right)^2}\,y}e^{-j(k_{pw,x}x+k_{pw,z}z)}. \tag{18}$$

In this formula, when the wave number $k_{p\ w,\ y}$ is substituted into Formula (15), a sign of the wave number $k_{p\ w,\ y}$ becomes physically-meaningless solution in a positive term. Thus, a term with a negative sign is substituted.

In addition, $(k_{p\ w,\ x}^2+k_{p\ w,\ z}^2-(\omega/c)^2)^{1/2}$ in Formula (18) is a term for defining the magnitude of the decay of the evanescent wave.

Accordingly, for example, in a case where a fixed magnitude of decay that is independent of the angular frequency ω is desired, it is only required that the wave number $k_{p\ w,\ x}$ and the wave number $k_{p\ w,\ z}$ be set so as to satisfy the following formula (19) using a constant α representing the magnitude of the decay. At this time, as seen from Formula (18), as the constant α becomes larger, a decay rate of the evanescent wave in the y direction becomes larger. Such a constant α indicated in Formula (19) is the above-described constant indicating a sound pressure decay rate in the y direction.

[Math. 19]

$$\alpha = \sqrt{k_{pw,x}^2 + k_{pw,z}^2 - \left(\frac{\omega}{c}\right)^2}. \tag{19}$$

Here, consideration will be given to obtaining a neighboring sound reproduction filter coefficient for obtaining a neighboring sound reproduction signal that generates the evanescent wave represented by Formula (18).

When spatial Fourier transform of Formula (18) is performed for x, a resultant value is represented as indicated in the following formula (20).

[Math. 20]

$$P(k_x,y,z,\omega)=4\pi^2\delta(\omega-\omega_{pw})\delta(k_x-k_{pw,x})e^{-\alpha y}e^{-jk_{pw,z}z} \tag{20}$$

In addition, a spatial frequency spectrum G' ($k_x$, y, z, ω) of the transfer function is represented as indicated in the following formula (21).

[Math. 21]

$$G'(k_x, y, z, \omega) = \begin{cases} -\frac{j}{4}H_0^{(2)}\left(\sqrt{\left(\frac{\omega}{c}\right)^2 - k_x^2}\sqrt{y^2+z^2}\right) & \text{for } |k_x| \le \left|\frac{\omega}{c}\right| \\ \frac{1}{2\pi}K_0\left(\sqrt{k_x^2 - \left(\frac{\omega}{c}\right)^2}\sqrt{y^2+z^2}\right) & \text{for } |k_x| > \left|\frac{\omega}{c}\right| \end{cases}. \tag{21}$$

Note that, in Formula (21), $H_0^{(2)}$ denotes a Hankel function of the second kind and $K_0$ denotes a Bessel function.

Furthermore, by the SDM using Formulae (20) and (21), a spatial frequency spectrum D' ($k_x$, ω) of a neighboring sound reproduction signal becomes as indicated in the following formula (22).

[Math. 22]

$$D'(k_x, \omega) = \frac{8\pi^3 e^{-\alpha y_{ref}} e^{-jk_{pw,z}z}}{K_0(\alpha y_{ref})}\delta(\omega-\omega_{pw})\delta(k_x-k_{pw,x}). \tag{22}$$

In Formula (22), $y_{ref}$ denotes a position of a control point serving as a reference in the y direction.

By performing inverse spatial Fourier transform of Formula (22) obtained in this manner, for the wave number $k_x$, a time frequency spectrum D (x, ω) of a neighboring sound reproduction signal that is indicated in the following formula (23) is obtained.

[Math. 23]

$$D(x, \omega) = \frac{4\pi^2 e^{-\alpha y_{ref}} e^{-jk_{pw,z}z}}{K_0(\alpha y_{ref})}e^{-jk_{pw,x}x}\delta(\omega-\omega_{pw}). \tag{23}$$

Furthermore, when inverse time Fourier transform of the time frequency spectrum D (x, ω) obtained in this manner is performed, a time waveform d (x, t) of a neighboring sound reproduction signal, that is to say, a speaker drive signal d (x, t) being a temporal signal is obtained as indicated in the following formula (24).

[Math. 24]

$$d(x, t) = \frac{2\pi e^{-\alpha y_{ref}} e^{-jk_{pw,z}z}}{K_0(\alpha y_{ref})} e^{-jk_{pw,x}x} e^{-j\omega_{pw}t}. \quad (24)$$

At this time, when an index for identifying a speaker constituting the speaker array 28, and indicating a position in the x direction of the speaker is denoted by l, as indicated in the following formula (25), a neighboring sound reproduction filter coefficient $h_n$ (l, m) of the speaker with the index l is obtained from Formula (24).

[Math. 25]

$$h_n(l, m) = \frac{2\pi e^{-\alpha y_{ref}} e^{-jk_{pw,z}z}}{K_0(\alpha y_{ref})} e^{-jk_{pw,x}l} e^{-j\omega_{pw}m}. \quad (25)$$

Note that, in Formula (25), m denotes a time index. The neighboring sound reproduction filter coefficient $h_n$ (l, m) is obtained by replacing x in the speaker drive signal d (x, t) indicated in Formula (24), with the index l, and replacing t with a time index m.

In the neighboring sound reproduction filter coefficient recording unit 52, neighboring sound reproduction filter coefficients $h_n$ (l, m) for respective combinations of positions $y_{ref}$ of a plurality of control points and a plurality of constants α are prerecorded.

Accordingly, among these neighboring sound reproduction filter coefficients $h_n$ (l, m), the filter coefficient selection unit 53 reads out, from the neighboring sound reproduction filter coefficient recording unit 52, a neighboring sound reproduction filter coefficient $h_n$ (l, m) of a control point and a constant α that are the same as a control point and a constant α that are indicated by the neighboring sound reproduction filter coefficient selection information supplied from the sound field boundary control unit 51, and supplies the read neighboring sound reproduction filter coefficient $h_n$ (l, m) to the filter unit 26.

In addition, the above description has been given of a method of obtaining an evanescent wave in a wavenumber domain and calculating a neighboring sound reproduction filter coefficient $h_n$ (l, m), but a neighboring sound reproduction filter coefficient $h_n$ (l, m) for generating an evanescent wave may be obtained by a method other than this.

(Filter Unit)

For example, a sound source signal supplied from the gain adjustment unit 22 to the filter unit 23 and a sound source signal supplied from the gain adjustment unit 25 to the filter unit 26 are assumed to be described as sound source signals x (n) without specifically making a distinction. Note that n in the sound source signal x (n) denotes a time index.

In addition, in a case where there is no need to distinguish between a remote sound reproduction filter coefficient $h_f$ (l, m) and a neighboring sound reproduction filter coefficient $h_n$ (l, m), these filter coefficients are assumed to also be referred to as filter coefficients h (l, m).

In the filter unit 23 and the filter unit 26, processing of convoluting the supplied sound source signal x (n) and the filter coefficient h (l, m) and obtaining a speaker drive signal s (l, n) is performed. In other words, in the filter unit 23 and the filter unit 26, calculation of the following formula (26) is performed for each speaker constituting the speaker array 28, and the speaker drive signal s (l, n) of each speaker identified by the speaker index l is calculated.

[Math. 26]

$$s(l, n) = \sum_{m=0}^{N} h(l, m) \times (n - m). \quad (26)$$

Note that, in Formula (26), N denotes a filter length.

The speaker drive signal s (l, n) of each speaker that has been obtained in the filter unit 23 by such calculation of Formula (26) is a remote sound reproduction signal. In addition, the speaker drive signal s (l, n) of each speaker that has been obtained in the filter unit 26 by such calculation of Formula (26) is a neighboring sound reproduction signal.

<Description of Remote-Neighborhood Separate Sound Field Formation Processing>

Subsequently, an operation of the remote-neighborhood separate sound field formation device 11 will be described. In other words, hereinafter, remote-neighborhood separate sound field formation processing performed by the remote-neighborhood separate sound field formation device 11 will be described with reference to a flowchart in FIG. 8.

In step S11, the sound field boundary control unit 41 and the sound field boundary control unit 51 decide a sound field boundary position on the basis of supplied control information.

For example, the sound field boundary control unit 41 and the sound field boundary control unit 51 define, on the basis of a position of a listener that is indicated by listener position information supplied as the control information, an audible region of a neighboring sound and an audible region of a remote sound, and define a position between these audible regions as a sound field boundary position. In addition, for example, the sound field boundary control unit 41 and the sound field boundary control unit 51 directly use, as a sound field boundary position, a position indicated by boundary position information supplied as the control information.

In step S12, the sound field boundary control unit 41 and the sound field boundary control unit 51 decide each parameter such as a remote sound gain value on the basis of the sound field boundary position decided in the process in step S11.

In other words, as described with reference to FIGS. 5 to 7, for example, in accordance with the sound field boundary position, the sound field boundary control unit 41 and the sound field boundary control unit 51 decide, as parameters, the respective values of a remote sound gain value, a neighboring sound gain value, a position of a control point of a remote sound reproduction filter coefficient, a position of a control point of a neighboring sound reproduction filter coefficient, and a constant α of a neighboring sound reproduction filter coefficient.

Note that, among these parameters, values of some parameters may be set to predefined values, and values of remaining parameters may be decided on the basis of the sound field boundary position. In addition, instead of deciding a sound field boundary position and then deciding values of the respective parameters in accordance with the sound field boundary position, a sound field boundary position and values of the respective parameters may be simultaneously decided while being mutually adjusted. In other words, the processes in steps S11 and S12 may be simultaneously performed.

When each parameter is decided, the sound field boundary control unit 41 supplies, to the gain adjustment unit 22, a remote sound gain value serving as a decided parameter, and supplies, to the filter coefficient selection unit 43, information indicating a position of a control point of a remote sound reproduction filter coefficient serving as a decided parameter, as remote sound reproduction filter coefficient selection information.

In addition, the sound field boundary control unit 51 supplies, to the gain adjustment unit 25, a neighboring sound gain value serving as a decided parameter, and supplies, to the filter coefficient selection unit 53, information indicating a position of a control point and a constant $\alpha$ of a neighboring sound reproduction filter coefficient that serve as decided parameters, as neighboring sound reproduction filter coefficient selection information.

In step S13, the filter coefficient selection unit 43 and the filter coefficient selection unit 53 select filter coefficients.

Specifically, from among remote sound reproduction filter coefficients of a plurality of respective control points, the filter coefficient selection unit 43 selects a remote sound reproduction filter coefficient of a control point that is indicated by the remote sound reproduction filter coefficient selection information supplied from the sound field boundary control unit 41. In other words, a remote sound reproduction filter coefficient corresponding to the position of the control point that is indicated by the remote sound reproduction filter coefficient selection information is selected.

Then, the filter coefficient selection unit 43 reads out the selected remote sound reproduction filter coefficient from the remote sound reproduction filter coefficient recording unit 42, and supplies the read remote sound reproduction filter coefficient to the filter unit 23.

In a similar manner, from among neighboring sound reproduction filter coefficients of the respective combinations of a plurality of control points and constants $\alpha$, the filter coefficient selection unit 53 selects a neighboring sound reproduction filter coefficient of a position of a control point and a constant $\alpha$ that are indicated by the neighboring sound reproduction filter coefficient selection information supplied from the sound field boundary control unit 51. In other words, a neighboring sound reproduction filter coefficient corresponding to the position of the control point and the constant $\alpha$ that are indicated by the neighboring sound reproduction filter coefficient selection information is selected.

The, the filter coefficient selection unit 53 reads out the selected neighboring sound reproduction filter coefficient from the neighboring sound reproduction filter coefficient recording unit 52, supplies the read neighboring sound reproduction filter coefficient to the filter unit 26.

In step S14, the gain adjustment unit 22 and the gain adjustment unit 25 perform gain adjustment of the supplied sound source signals.

In other words, the gain adjustment unit 22 performs the gain adjustment by multiplying the supplied sound source signal by the remote sound gain value supplied from the sound field boundary control unit 41, and supplies the resultant sound source signal to the filter unit 23.

In addition, the gain adjustment unit 25 performs the gain adjustment by multiplying the supplied sound source signal by the neighboring sound gain value supplied from the sound field boundary control unit 51, and supplies the resultant sound source signal to the filter unit 26.

In step S15, the filter unit 23 and the filter unit 26 perform filter processing on the sound source signals.

In other words, for example, the filter unit 23 generates a remote sound reproduction signal by convoluting the sound source signal supplied from the gain adjustment unit 22 and the remote sound reproduction filter coefficient supplied from the filter coefficient selection unit 43 by performing the above-described calculation of Formula (26), and supplies the generated remote sound reproduction signal to the addition unit 27.

In addition, for example, the filter unit 26 generates a neighboring sound reproduction signal by convoluting the sound source signal supplied from the gain adjustment unit 25 and the neighboring sound reproduction filter coefficient supplied from the filter coefficient selection unit 53 by performing the above-described calculation of Formula (26), and supplies the generated neighboring sound reproduction signal to the addition unit 27.

Note that, here, the description has been given of an example in which the remote sound reproduction signal and the neighboring sound reproduction signal are generated using the sound source signals having been subjected to the gain adjustment. Nevertheless, a remote sound reproduction signal and a neighboring sound reproduction signal may be generated using sound source signals not having been subjected to gain adjustment, and gain adjustment may be performed on the remote sound reproduction signal and the neighboring sound reproduction signal.

In such a case, for example, gain adjustment is performed by the gain adjustment unit 22 on a remote sound reproduction signal on the basis of a remote sound gain value, and gain adjustment is performed by the gain adjustment unit 25 on a neighboring sound reproduction signal on the basis of a neighboring sound gain value.

In step S16, the addition unit 27 generates a speaker drive signal by adding the remote sound reproduction signal supplied from the filter unit 23 and the neighboring sound reproduction signal supplied from the filter unit 26, and supplies the generated speaker drive signal to the speaker array 28.

In step S17, the speaker array 28 simultaneously reproduces a remote sound and a neighboring sound on the basis of the speaker drive signal supplied from the addition unit 27, and the remote-neighborhood separate sound field formation processing ends.

When a remote sound and a neighboring sound are simultaneously reproduced in this manner, a remote sound reproduction sound field and a neighboring sound reproduction sound field are formed in mutually different regions in a space. In other words, an audible region of a remote sound and an audible region of a neighboring sound are formed at mutually different positions.

In the above-described manner, the remote-neighborhood separate sound field formation device 11 decides each parameter such as a remote sound gain value in accordance with a sound field boundary position, performs gain adjustment and filter processing in accordance with the decided parameters, and generates a speaker drive signal for reproducing a remote sound and a neighboring sound. In this manner, different sounds can be reproduced in a remote location and a neighboring location.

Second Embodiment

<Configuration Example of Remote-Neighborhood Separate Sound Field Formation Device>

Note that the above description has been given of an example of generating a speaker drive signal by adding a remote sound reproduction signal and a neighboring sound reproduction signal, and reproducing a remote sound and a neighboring sound by one speaker array 28, but a remote sound and a neighboring sound may be respectively reproduced by different speaker arrays.

Figure 9:
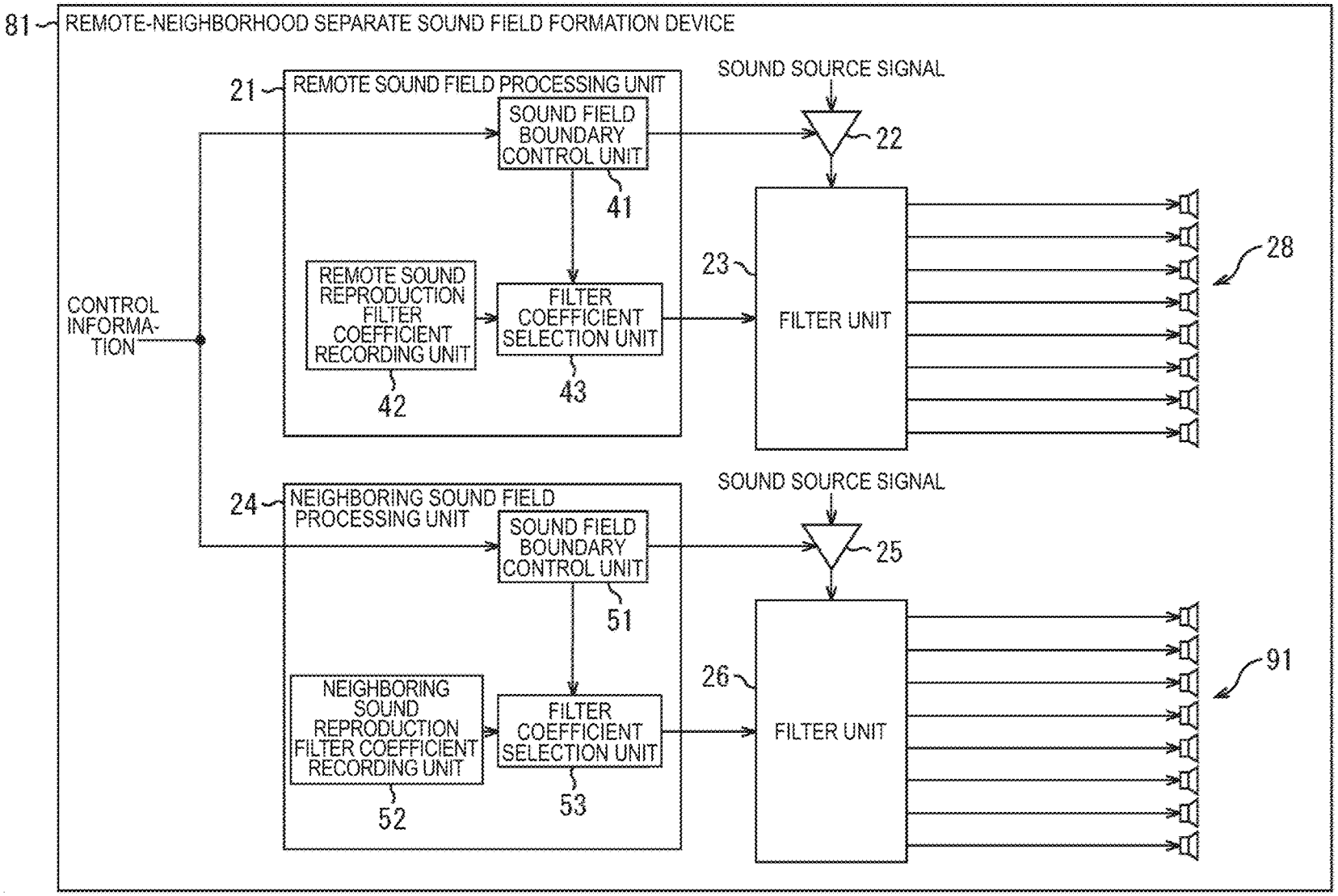
FIG. 9 is a diagram illustrating a configuration example of a remote-neighborhood separate sound field formation device.

In such a case, a remote-neighborhood separate sound field formation device is formed as illustrated FIG. 9, for example. Note that, in FIG. 9, portions corresponding to those in the case in FIG. 3 are denoted with the same reference numerals, and the description thereof will be appropriately omitted.

A remote-neighborhood separate sound field formation device 81 illustrated in FIG. 9 includes the remote sound field processing unit 21, the gain adjustment unit 22, the filter unit 23, the neighboring sound field processing unit 24, the gain adjustment unit 25, the filter unit 26, the speaker array 28, and a speaker array 91.

In addition, in the remote sound field processing unit 21, the sound field boundary control unit 41, the remote sound reproduction filter coefficient recording unit 42, and the filter coefficient selection unit 43 are provided, and in the neighboring sound field processing unit 24, the sound field boundary control unit 51, the neighboring sound reproduction filter coefficient recording unit 52, and the filter coefficient selection unit 53 are provided.

The configuration of the remote-neighborhood separate sound field formation device 81 differs from the configuration of the remote-neighborhood separate sound field formation device 11 in FIG. 3 in that the addition unit 27 is not provided and the speaker array 91 is newly provided, and has the same configuration as that of the remote-neighborhood separate sound field formation device 11 in other points.

In the remote-neighborhood separate sound field formation device 81, a remote sound reproduction signal obtained in the filter unit 23 is supplied to the speaker array 28, and in the speaker array 28, a remote sound is reproduced on the basis of the remote sound reproduction signal. In addition, a neighboring sound reproduction signal obtained in the filter unit 26 is supplied to the speaker array 91.

The speaker array 91 is a speaker array obtained by arranging a plurality of speakers, such as a linear speaker array, a planar speaker array, an annular speaker array, or a spherical speaker array, for example, and reproduces a neighboring sound on the basis of the neighboring sound reproduction signal supplied from the filter unit 26.

Here, the speaker array 28 and the speaker array 91 may be arranged at the same position in the y direction, or may be arranged at different positions in the y direction.

For example, in a case where the respective arrangement positions in the y direction of the speaker array 28 and the speaker array 91 are different, a neighboring sound reproduction sound field can be formed not only by an evanescent wave, but also by a propagating wave such as a planar wave or a spherical wave.

This is because, even if a way of decaying in the y direction of a sound pressure of a remote sound and a way of decaying in the y direction of a sound pressure of a neighboring sound are similar, for example, if positions in the y direction of speaker arrays that reproduce the remote sound and the neighboring sound are different, decay curves of the sound pressures of these sounds, that is to say, a curved line corresponding to the curved line L32 illustrated in FIG. 6, for example, has an intersection.

Thus, a neighboring sound reproduction filter coefficient can be set to a filter coefficient for forming a neighboring sound reproduction sound field using planar waves, spherical waves, or the like that is generated similarly to the case in a remote sound reproduction filter coefficient, for example.

<Description of Remote-Neighborhood Separate Sound Field Formation Processing>

Figure 10:
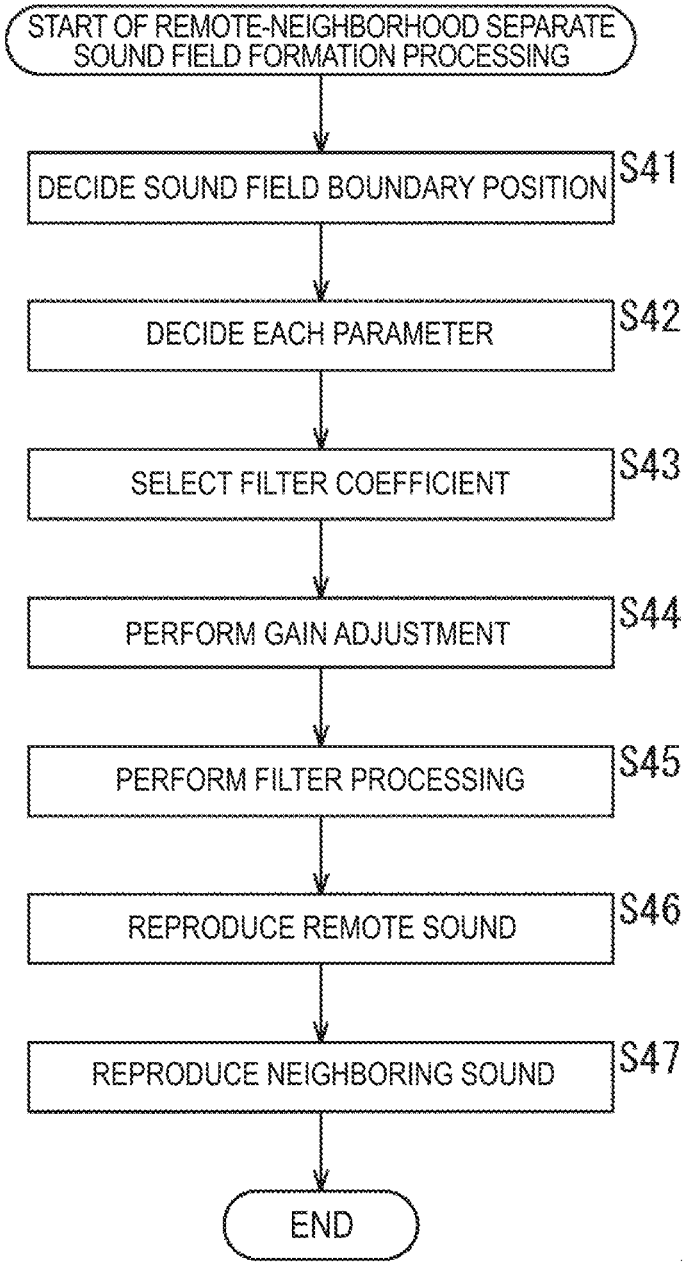
FIG. 10 is a flowchart describing remote-neighborhood separate sound field formation processing.

Next, an operation of the remote-neighborhood separate sound field formation device 81 illustrated in FIG. 9 will be described. In other words, hereinafter, remote-neighborhood separate sound field formation processing performed by the remote-neighborhood separate sound field formation device 81 will be described with reference to a flowchart in FIG. 10.

Figure 8:
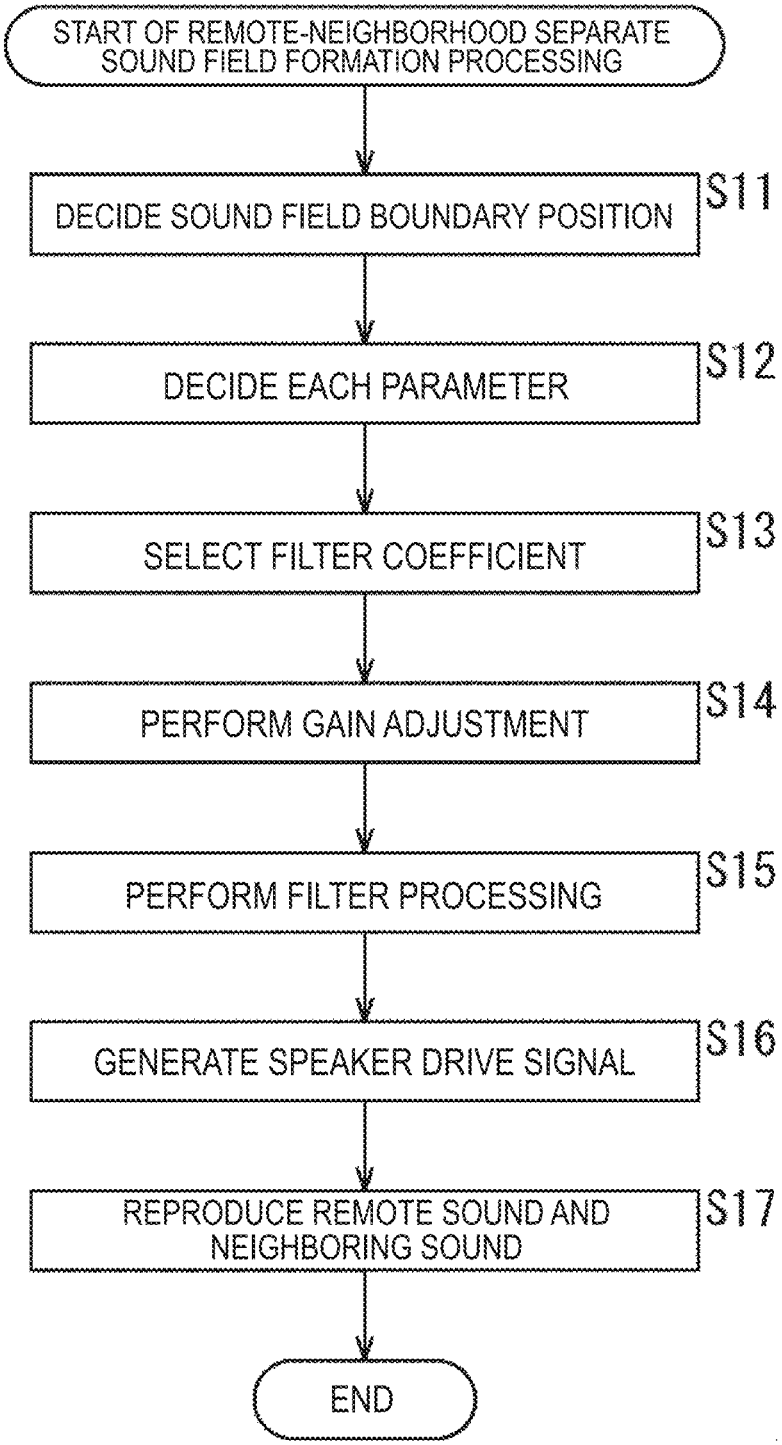
FIG. 8 is a flowchart describing remote-neighborhood separate sound field formation processing.

Note that, because the processes in steps S41 to S45 are similar to the processes in steps S11 to S15 in FIG. 8, the description thereof will be omitted. Nevertheless, in step S45, the filter unit 23 supplies an obtained remote sound reproduction signal to the speaker array 28, and the filter unit 26 supplies an obtained neighboring sound reproduction signal to the speaker array 91.

In step S46, the speaker array 28 reproduces a remote sound on the basis of the remote sound reproduction signal supplied from the filter unit 23.

In addition, in step S47, the speaker array 91 reproduces a neighboring sound on the basis of the neighboring sound reproduction signal supplied from the filter unit 26.

Note that, more specifically, steps S46 and S47 are simultaneously performed. A remote sound reproduction sound field and a neighboring sound reproduction sound field are thereby formed in mutually different regions in a space. In other words, an audible region of a remote sound and an audible region of a neighboring sound are formed at mutually different positions.

When the remote sound and the neighboring sound are reproduced, the remote-neighborhood separate sound field formation processing ends.

In the above-described manner, the remote-neighborhood separate sound field formation device 81 decides each parameter such as a remote sound gain value in accordance with a sound field boundary position, performs gain adjustment and filter processing in accordance with the decided parameters, and generates a remote sound reproduction signal and a neighboring sound reproduction signal. Different sounds can be thereby reproduced in a remote location and a neighboring location.

Note that the above description has been given assuming that the remote sound and the neighboring sound are simultaneously reproduced, but the remote sound and the neighboring sound may be reproduced at different timings.

In such a case, for example, reproduction of a remote sound is performed at a timing at which reproduction of a neighboring sound is not performed. In addition, a remote sound may be reproduced when the sound volume of a neighboring sound is small. In other words, for example, a sound source signal for reproducing a neighboring sound is also supplied to the filter unit 23, and the filter unit 23 detects a time when the sound volume of the neighboring sound is small, such as a time when amplitude of the sound source signal for reproducing the neighboring sound is almost 0, that is to say, a timing at which a neighboring sound is not reproduced. Then, at the timing at which a neighboring sound is not reproduced, the filter unit 23 supplies a remote sound reproduction signal to the speaker array 28, and causes the speaker array 28 to reproduce a remote sound.

In this manner, a remote sound can be reproduced when a neighboring sound is not reproduced, that is to say, when a neighboring sound does not sound, and even at a position at which a difference between a sound pressure of a neighboring sound and a sound pressure of a remote sound is small, a listener can be prevented from hearing a mixed sound of the remote sound and the neighboring sound.

In addition, in the case of reproducing mutually different sounds using two speaker arrays, that is to say, the speaker array 28 and the speaker array 91, the speaker array 28 and the speaker array 91 may be arranged in the z direction, that is to say, arranged at positions with different heights, and reproduce sounds of mutually different pieces of content.

In such a case, for example, in the speaker array 28 arranged at a position higher in the z direction, content oriented for tall adults can be reproduced, and in the speaker array 91 arranged at a position lower in the z direction, content oriented for short children can be reproduced. In this example, also in the neighborhood of the speaker arrays, pieces of content mutually different for height can be reproduced.

Furthermore, for example, in a case where the speaker array 28 and the speaker array 91 are arranged at different heights in the z direction, two sounds having mutually different audible regions may be reproduced by one speaker array as described in the first embodiment.

In such a case, a remote sound and a neighboring sound are reproduced by the speaker array 28, and in addition, a remote sound and a neighboring sound are also reproduced by the speaker array 91, so that four sound fields having mutually different positions of audible regions in the z direction and the y direction can be formed. At this time, a sound field boundary position of the remote sound and the neighboring sound that are reproduced by the speaker array 28, and a sound field boundary position of the remote sound and the neighboring sound that are reproduced by the speaker array 91 can be set to different positions in the y direction. In other words, the sound field boundary positions can be independently controlled.

In this manner, if a remote sound and a neighboring sound are reproduced by each of two speaker arrays, mutually different four pieces of content can be reproduced without sounds thereof being mixed.

In addition, in the case of forming different sound fields in a remote location and a neighboring location, a video may be presented in combination. For example, by installing a polarization plate or the like together with a display device above the speaker array 28, different videos (images) can be presented by the display device to a listener existing in an audible region of a remote sound and a listener existing in an audible region of a neighboring sound.

Accordingly, for example, to a listener existing in an audible region of a remote sound, content including a video viewable from the inside of the audible region and the remote sound can be presented, and to a listener existing in an audible region of a neighboring sound, content including a video viewable from the inside of the audible region and the neighboring sound can be presented. In other words, to a listener existing in an audible region of a remote sound and a listener existing in an audible region of a neighboring sound, different pieces of content each including a video and a voice can be presented.

Additionally, for example, in a case where a sound heard only in a speaker array neighborhood is desired to be reproduced, a remote sound may be used for masking of a neighboring sound. In other words, a remote sound can be used as a voice for masking of a neighboring sound.

In such a case, for example, BGM having the same frequency band as a neighboring sound or the like is used as a remote sound, and the remote sound and the neighboring sound are simultaneously reproduced by the remote-neighborhood separate sound field formation device 11 or the remote-neighborhood separate sound field formation device 81. The neighboring sound can be thereby made almost-unheard on the outside of the audible region of the neighboring sound. In other words, leakage of the neighboring sound to the outside of the audible region can be reduced.

In this manner, in the case of using a remote sound as a voice for masking of a neighboring sound, when a sound in a frequency band at least including all frequency bands of the neighboring sound is used as the remote sound, a masking effect can be enhanced.

<Example of Computer Configuration>

Incidentally, the above-described series of processes may be performed by hardware or may be performed by software. When the series of processes are performed by software, a program forming the software is installed into a computer. Examples of the computer include a computer that is incorporated in dedicated hardware and a general-purpose computer that can perform various types of function by installing various types of program.

Figure 11:
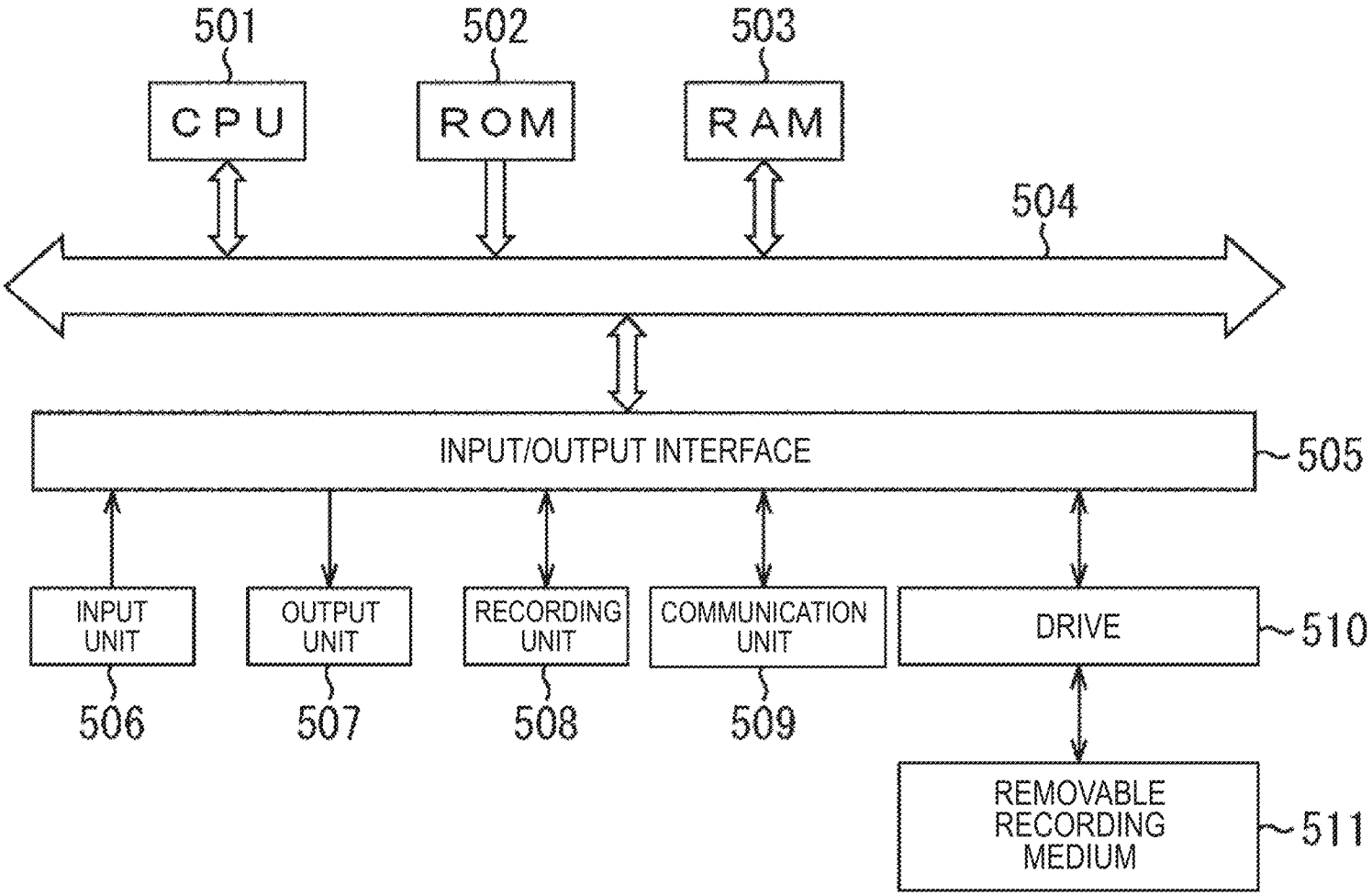
FIG. 11 is a diagram illustrating a configuration example of a computer.

FIG. 11 is a block diagram illustrating a configuration example of the hardware of a computer that performs the above-described series of processes with a program.

In the computer, a central processing unit (CPU) 501, read only memory (ROM) 502, and random access memory (RAM) 503 are mutually connected by a bus 504.

Further, an input/output interface 505 is connected to the bus 504. Connected to the input/output interface 505 are an input unit 506, an output unit 507, a recording unit 508, a communication unit 509, and a drive 510.

The input unit 506 includes a keyboard, a mouse, a microphone, an image sensor, and the like. The output unit 507 includes a display, a speaker array, and the like. The recording unit 508 includes a hard disk, a non-volatile memory, and the like. The communication unit 509 includes a network interface, and the like. The drive 510 drives a removable recording medium 511 such as a magnetic disk, an optical disc, a magneto-optical disk, and a semiconductor memory.

In the computer configured as described above, the CPU 501 loads a program that is recorded, for example, in the recording unit 508 onto the RAM 503 via the input/output interface 505 and the bus 504, and executes the program, thereby performing the above-described series of processes.

For example, programs to be executed by the computer (CPU 501) can be recorded and provided in the removable recording medium 511, which is a packaged medium or the like. In addition, programs can be provided via a wired or wireless transmission medium such as a local area network, the Internet, and digital satellite broadcasting.

In the computer, by mounting the removable recording medium 511 onto the drive 510, programs can be installed into the recording unit 508 via the input/output interface 505. Programs can also be received by the communication unit 509 via a wired or wireless transmission medium, and installed into the recording unit 508. In addition, programs can be installed in advance into the ROM 502 or the recording unit 508.

Note that a program executed by the computer may be a program in which processes are chronologically carried out in a time series in the order described herein or may be a program in which processes are carried out in parallel or at necessary timing, such as when the processes are called.

In addition, embodiments of the present disclosure are not limited to the above-described embodiments, and various alterations may occur insofar as they are within the scope of the present disclosure.

For example, the present technology can adopt a configuration of cloud computing, in which a plurality of devices shares a single function via a network and perform processes in collaboration.

Furthermore, each step in the above-described flowcharts can be executed by a single device or shared and executed by a plurality of devices.

In addition, when a single step includes a plurality of processes, the plurality of processes included in the single step can be executed by a single device or shared and executed by a plurality of devices.

The advantageous effects described herein are not limited, but merely examples. Any other advantageous effects may also be attained.

Additionally, the present technology may also be configured as below.

(1)

A signal processing device including:

a remote filter unit configured to generate a remote sound reproduction signal for reproducing a sound in a remote audible region, by performing filter processing on a first sound source signal using a remote sound reproduction filter coefficient; and a neighboring filter unit configured to generate a neighboring sound reproduction signal for reproducing a sound in a neighboring audible region that is different from the remote audible region, by performing filter processing on a second sound source signal using a neighboring sound reproduction filter coefficient.

(2)

The signal processing device according to (1), in which the neighboring sound reproduction signal is a signal for generating an evanescent wave.

(3)

The signal processing device according to (2), further including:

a neighboring sound field processing unit configured to decide a decay rate of the evanescent wave in accordance with a boundary position of the remote audible region and the neighboring audible region, in which the neighboring filter unit performs filter processing using the neighboring sound reproduction filter coefficient corresponding to the decided decay rate among a plurality of the neighboring sound reproduction filter coefficients.

(4)

The signal processing device according to (1) or (2), further including:

a neighboring sound field processing unit configured to decide a position of a control point in accordance with a boundary position of the remote audible region and the neighboring audible region, in which the neighboring filter unit performs filter processing using the neighboring sound reproduction filter coefficient corresponding to the decided position of the control point among a plurality of the neighboring sound reproduction filter coefficients.

(5)

The signal processing device according to any one of (1) to (4), further including:

a remote sound field processing unit configured to decide a position of a control point in accordance with a boundary position of the remote audible region and the neighboring audible region, in which the remote filter unit performs filter processing using the remote sound reproduction filter coefficient corresponding to the decided position of the control point among a plurality of the remote sound reproduction filter coefficients.

(6)

The signal processing device according to any one of (1) to (5), in which the remote sound reproduction signal is a signal for generating a propagating wave.

(7)

The signal processing device according to any one of (1) to (6), further including:

a remote sound field processing unit configured to decide a gain in accordance with a boundary position of the remote audible region and the neighboring audible region; and a remote gain adjustment unit configured to perform gain adjustment of the first sound source signal or the remote sound reproduction signal on a basis of the decided gain.

(8)

The signal processing device according to any one of (1) to (7), further including:

a neighboring sound field processing unit configured to decide a gain in accordance with a boundary position of the remote audible region and the neighboring audible region; and a neighboring gain adjustment unit configured to perform gain adjustment of the second sound source signal or the neighboring sound reproduction signal on a basis of the decided gain.

(9)

The signal processing device according to any one of (1) to (8), in which the first sound source signal and the second sound source signal are signals for reproducing sounds of mutually different pieces of content.

(10)

The signal processing device according to any one of (1) to (9), further including:

a speaker array configured to reproduce a sound on a basis of a signal obtained by synthesizing the remote sound reproduction signal and the neighboring sound reproduction signal.

(11)

The signal processing device according to any one of (1) to (9), further including:

a first speaker array configured to reproduce a sound on a basis of the remote sound reproduction signal; and a second speaker array configured to reproduce a sound on a basis of the neighboring sound reproduction signal.

(12)

The signal processing device according to any one of (1) to (11), in which a sound that is based on the remote sound reproduction signal is reproduced at a timing different from a timing of a sound that is based on the neighboring sound reproduction signal.

(13)

The signal processing device according to any one of (1) to (11), in which a sound that is based on the remote sound reproduction signal is a sound for masking of a sound that is based on the neighboring sound reproduction signal.

(14)

The signal processing device according to any one of (1) to (13), further including:

a sound field boundary control unit configured to decide a boundary position of the remote audible region and the neighboring audible region on a basis of a position of a listener in a space.

(15)

A signal processing method including the steps of:

generating a remote sound reproduction signal for reproducing a sound in a remote audible region, by performing filter processing on a first sound source signal using a remote sound reproduction filter coefficient; and generating a neighboring sound reproduction signal for reproducing a sound in a neighboring audible region that is different from the remote audible region, by performing filter processing on a second sound source signal using a neighboring sound reproduction filter coefficient.

(16)

A program for causing a computer to execute processing including the steps of:

generating a remote sound reproduction signal for reproducing a sound in a remote audible region, by performing filter processing on a first sound source signal using a remote sound reproduction filter coefficient; and generating a neighboring sound reproduction signal for reproducing a sound in a neighboring audible region that is different from the remote audible region, by performing filter processing on a second sound source signal using a neighboring sound reproduction filter coefficient.

REFERENCE SIGNS LIST

11 remote-neighborhood separate sound field formation device
21 remote sound field processing unit
22 gain adjustment unit
23 filter unit
24 neighboring sound field processing unit
25 gain adjustment unit
26 filter unit
28 speaker array
41 sound field boundary control unit
42 remote sound reproduction filter coefficient recording unit
43 filter coefficient selection unit
51 sound field boundary control unit
52 neighboring sound reproduction filter coefficient recording unit
53 filter coefficient selection unit
91 speaker array

The invention claimed is:

1. A signal processing device comprising:

a remote filter unit configured to generate a remote sound reproduction signal for reproducing a first sound in a remote audible region, by performing a first filter processing on a first sound source signal using a remote sound reproduction filter coefficient, the remote filter unit including:

a remote sound field boundary control unit, a remote sound reproduction filter coefficient selection unit, and a remote sound reproduction filter coefficient recording unit, wherein the remote sound field boundary control unit is configured to receive a control signal, to determine a first boundary position of a listener based on the control signal, and to provide first selection information to the remote sound reproduction filter coefficient selection unit, and wherein the remote sound reproduction filter coefficient selection unit is configured to select the remote sound reproduction filter coefficient from a plurality of remote sound reproduction filter coefficients recorded in the remote sound reproduction recording unit based on the first selection information; and a neighboring filter unit configured to generate a neighboring sound reproduction signal for reproducing a second sound in a neighboring audible region that is different from the remote audible region, by performing a second filter processing on a second sound source signal using a neighboring sound reproduction filter coefficient, the neighboring filter unit including:

a neighboring sound field boundary control unit, a neighboring sound reproduction filter coefficient selection unit, and a neighboring sound reproduction filter coefficient recording unit, wherein the neighboring sound field boundary control unit is configured to receive the control signal, to determine a second boundary position of the listener based on the control signal, and to provide second selection information to the neighboring sound reproduction filter coefficient selection unit, and wherein the neighboring sound reproduction filter coefficient selection unit is configured to select the neighboring sound reproduction filter coefficient from a plurality of neighboring sound reproduction filter coefficients recorded in the neighboring sound reproduction recording unit.

2. The signal processing device according to claim 1, wherein the neighboring sound reproduction signal is a signal for generating an evanescent wave.

3. The signal processing device according to claim 2, further comprising:

a neighboring sound field processing unit configured to decide a decay rate of the evanescent wave in accordance with a boundary position of the remote audible region and the neighboring audible region, wherein the neighboring sound reproduction filter coefficient is selected from the plurality of neighboring sound reproduction filter coefficients according to the decided decay rate.

4. The signal processing device according to claim 1, further comprising:

a neighboring sound field processing unit configured to decide a position of a control point in accordance with a boundary position of the remote audible region and the neighboring audible region, wherein the neighboring sound reproduction filter coefficient is selected from the plurality of neighboring sound reproduction filter coefficients according to the decided position of the control point.

5. The signal processing device according to claim 1, further comprising:

a remote sound field processing unit configured to decide a position of a control point in accordance with a boundary position of the remote audible region and the neighboring audible region, wherein the remote sound reproduction filter coefficient is selected from the plurality of remote sound reproduction filter coefficients according to the decided position of the control point.

6. The signal processing device according to claim 1, wherein the remote sound reproduction signal is a signal for generating a propagating wave.

7. The signal processing device according to claim 1, further comprising:

a remote sound field processing unit configured to decide a gain in accordance with a boundary position of the remote audible region and the neighboring audible region; and a remote gain adjustment unit configured to perform gain adjustment of the first sound source signal or the remote sound reproduction signal on a basis of the decided gain.

8. The signal processing device according to claim 1, further comprising:

a neighboring sound field processing unit configured to decide a gain in accordance with a boundary position of the remote audible region and the neighboring audible region; and a neighboring gain adjustment unit configured to perform gain adjustment of the second sound source signal or the neighboring sound reproduction signal on a basis of the decided gain.

9. The signal processing device according to claim 1, wherein the first sound source signal and the second sound source signal are signals for reproducing sounds of mutually different pieces of content.

10. The signal processing device according to claim 1, further comprising: a speaker array configured to reproduce a sound on a basis of a signal obtained by synthesizing the remote sound reproduction signal and the neighboring sound reproduction signal.

11. The signal processing device according to claim 1, further comprising:

a first speaker array configured to reproduce a sound on a basis of the remote sound reproduction signal; and a second speaker array configured to reproduce a sound on a basis of the neighboring sound reproduction signal.

12. The signal processing device according to claim 1, wherein a sound that is based on the remote sound reproduction signal is reproduced at a timing different from a timing of a sound that is based on the neighboring sound reproduction signal.

13. The signal processing device according to claim 1, wherein a sound that is based on the remote sound reproduction signal is a sound for masking of a sound that is based on the neighboring sound reproduction signal.

14. The signal processing device according to claim 1, wherein the first boundary position and the second position comprise a boundary position of the remote audible region and the neighboring audible region.

15. A signal processing method comprising steps of:

generating a remote sound reproduction signal for reproducing a first sound in a remote audible region, by performing a first filter processing on a first sound source signal using a remote sound reproduction filter coefficient, the generating of the remote sound reproduction signal including:

determining a first boundary position of a listener based on a control signal, determining first selection information based on the first boundary position, and using the first selection information to select the remote sound reproduction filter coefficient from a plurality of remote sound reproduction filter coefficients recorded in the remote sound reproduction recording unit; and generating a neighboring sound reproduction signal for reproducing a second sound in a neighboring audible region that is different from the remote audible region, by performing a second filter processing on a second sound source signal using a neighboring sound reproduction filter coefficient, the generating of the neighboring sound reproduction signal including:

determining a second boundary position of the listener based on the control signal, determining second selection information based on the second boundary position, and using the second selection information to select the neighboring sound reproduction filter coefficient from a plurality of neighboring sound reproduction filter coefficients recorded in the neighboring sound reproduction recording unit.

16. A non-transitory computer-readable storage medium storing a program that, when executed, causes a computer to perform a signal processing method, wherein the method comprises:

generating a remote sound reproduction signal for reproducing a first sound in a remote audible region, by performing a first filter processing on a first sound source signal using a remote sound reproduction filter coefficient, the generating of the remote sound reproduction signal including:

determining a first boundary position of a listener based on a control signal, determining first selection information based on the first boundary position, and using the first selection information to select the remote sound reproduction filter coefficient from a plurality of remote sound reproduction filter coefficients recorded in the remote sound reproduction recording unit; and generating a neighboring sound reproduction signal for reproducing a second sound in a neighboring audible region that is different from the remote audible region, by performing a second filter processing on a second sound source signal using a neighboring sound reproduction filter coefficient, the generating of the neighboring sound reproduction signal including:

determining a second boundary position of the listener based on the control signal, determining second selection information based on the second boundary position, and using the second selection information to select the neighboring sound reproduction filter coefficient from a plurality of neighboring sound reproduction filter coefficients recorded in the neighboring sound reproduction recording unit.

* * * * *